US011649682B1

(12) United States Patent
Miess et al.

(10) Patent No.: US 11,649,682 B1
(45) Date of Patent: May 16, 2023

(54) MULTI-PART SUPERABRASIVE COMPACTS, ROTARY DRILL BITS INCLUDING MULTI-PART SUPERABRASIVE COMPACTS, AND RELATED METHODS

(71) Applicant: US SYNTHETIC CORPORATION, Orem, UT (US)

(72) Inventors: David P. Miess, Highland, UT (US); Craig H. Cooley, Saratoga Springs, UT (US); Brian M. Shuey, Pleasant Grove, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

(21) Appl. No.: 17/451,535

(22) Filed: Oct. 20, 2021

Related U.S. Application Data

(63) Continuation of application No. 16/571,664, filed on Sep. 16, 2019, now Pat. No. 11,180,961, which is a continuation of application No. 15/669,655, filed on Aug. 4, 2017, now Pat. No. 10,450,808.

(60) Provisional application No. 62/380,191, filed on Aug. 26, 2016.

(51) Int. Cl.
*E21B 10/573* (2006.01)
*E21B 10/55* (2006.01)

(52) U.S. Cl.
CPC ..... *E21B 10/5735* (2013.01); *E21B 10/55* (2013.01)

(58) Field of Classification Search
CPC ..... E21B 10/55; E21B 10/5735
See application file for complete search history.

(56) References Cited

U.S. PATENT DOCUMENTS

| | | | |
|---|---|---|---|
| 4,268,276 | A | 5/1981 | Bovenkerk |
| 4,410,054 | A | 10/1983 | Nagel et al. |
| 4,468,138 | A | 8/1984 | Nagel |
| 4,560,014 | A | 12/1985 | Geczy |
| 4,738,322 | A | 4/1988 | Hall et al. |
| 4,811,801 | A | 3/1989 | Salesky et al. |
| 4,854,405 | A | 8/1989 | Stroud |
| 4,913,247 | A | 4/1990 | Jones |
| 5,016,718 | A | 5/1991 | Tandberg |

(Continued)

FOREIGN PATENT DOCUMENTS

| | | | |
|---|---|---|---|
| CA | 2760984 A1 * | 11/2010 | ..... E21B 10/55 |
| CA | 2760984 A1 | 11/2010 | |

(Continued)

OTHER PUBLICATIONS

Issue Notification for U.S. Appl. No. 15/669,655 dated Oct. 2, 2019.

(Continued)

*Primary Examiner* — Jennifer H Gay
(74) *Attorney, Agent, or Firm* — PCFB LLC

(57) ABSTRACT

Embodiments disclosed herein are directed to a superabrasive compact including one or more superabrasive cutting portions or segments, rotary drill bits including one or more superabrasive compacts, and related methods (e.g., methods of fabricating and/or operating the superabrasive compacts). For example, the superabrasive compact may include polycrystalline diamond that may form at least a portion of a working surface of the superabrasive compact.

21 Claims, 16 Drawing Sheets

(56) References Cited

U.S. PATENT DOCUMENTS

| | | | | |
|---|---|---|---|---|
| 5,092,687 | A | 3/1992 | Hall | |
| 5,120,327 | A | 6/1992 | Dennis | |
| 5,135,061 | A | 8/1992 | Newton, Jr. | |
| 5,154,245 | A | 10/1992 | Waldenstrom et al. | |
| 5,364,192 | A | 11/1994 | Damm et al. | |
| 5,368,398 | A | 11/1994 | Damm et al. | |
| 5,435,403 | A | 7/1995 | Tibbitts | |
| 5,460,233 | A | 10/1995 | Meany et al. | |
| 5,480,233 | A | 1/1996 | Cunningham | |
| 5,544,713 | A | 8/1996 | Dennis | |
| 6,131,678 | A | 10/2000 | Griffin | |
| 6,145,607 | A | 11/2000 | Griffin et al. | |
| 6,793,681 | B1 | 9/2004 | Pope et al. | |
| 7,493,972 | B1 * | 2/2009 | Schmidt | E21B 10/5735 175/432 |
| 7,533,740 | B2 | 5/2009 | Zhang et al. | |
| 7,866,418 | B2 | 1/2011 | Bertagnolli et al. | |
| 7,998,573 | B2 | 8/2011 | Qian et al. | |
| 8,034,136 | B2 | 10/2011 | Sani | |
| 8,146,687 | B1 | 4/2012 | Vail | |
| 8,236,074 | B1 | 8/2012 | Bertagnolli et al. | |
| 8,261,858 | B1 | 9/2012 | Atkins et al. | |
| 8,360,176 | B2 | 1/2013 | Zhang et al. | |
| 8,479,845 | B1 | 7/2013 | Qian et al. | |
| 8,701,798 | B1 | 4/2014 | Qian et al. | |
| 8,727,044 | B2 | 5/2014 | Qian et al. | |
| 8,764,864 | B1 | 7/2014 | Miess et al. | |
| 8,919,463 | B2 * | 12/2014 | Setlur | C22C 19/07 175/420.2 |
| 9,255,312 | B2 | 2/2016 | Goudemond et al. | |
| 9,434,091 | B2 | 9/2016 | Burton et al. | |
| 9,644,430 | B2 | 5/2017 | Scott et al. | |
| 9,849,561 | B2 | 12/2017 | Digiovanni et al. | |
| 10,022,840 | B1 | 7/2018 | Miess | |
| 10,105,826 | B2 * | 10/2018 | Gledhill | C22C 1/05 |
| 10,107,042 | B2 | 10/2018 | Yu et al. | |
| 10,107,043 | B1 | 10/2018 | Chapman et al. | |
| 10,214,967 | B2 * | 2/2019 | Alkhalaileh | C22C 26/00 |
| 10,450,808 | B1 | 10/2019 | Miess et al. | |
| 11,180,961 | B1 * | 11/2021 | Miess | E21B 10/5673 |
| 2003/0084894 | A1 | 5/2003 | Sung | |
| 2004/0009376 | A1 * | 1/2004 | Wan | E21B 10/5735 428/698 |
| 2005/0183893 | A1 | 8/2005 | Sjogren et al. | |
| 2006/0207802 | A1 | 9/2006 | Zhang et al. | |
| 2008/0115421 | A1 | 5/2008 | Sani | |
| 2008/0206576 | A1 | 8/2008 | Qian et al. | |
| 2009/0283089 | A1 | 11/2009 | Sung | |
| 2010/0314176 | A1 | 12/2010 | Zhang et al. | |
| 2011/0174549 | A1 | 7/2011 | Dolan et al. | |
| 2012/0097457 | A1 | 4/2012 | Setlur et al. | |
| 2012/0241225 | A1 * | 9/2012 | Briggs | E21B 10/5676 175/428 |
| 2013/0015000 | A1 | 1/2013 | Zhang et al. | |
| 2013/0167446 | A1 | 7/2013 | Lin et al. | |
| 2013/0167451 | A1 * | 7/2013 | Lin | B23K 31/025 51/307 |
| 2013/0199856 | A1 | 8/2013 | Bilen et al. | |
| 2014/0069725 | A1 | 3/2014 | Yu et al. | |
| 2014/0110180 | A1 | 4/2014 | Yu | |
| 2014/0237906 | A1 | 8/2014 | Alkhalaileh et al. | |
| 2014/0262540 | A1 | 9/2014 | Scott et al. | |
| 2014/0339883 | A1 | 11/2014 | Burton et al. | |
| 2015/0021100 | A1 | 1/2015 | Cheng | |
| 2015/0114725 | A1 * | 4/2015 | Alkhalaileh | C22C 26/00 175/428 |
| 2015/0283618 | A1 * | 10/2015 | DiGiovanni | C22C 26/00 51/307 |
| 2015/0314483 | A1 | 11/2015 | Miess et al. | |
| 2016/0318808 | A1 * | 11/2016 | Kasonde | B22F 3/14 |
| 2017/0266783 | A1 | 9/2017 | Gledhill et al. | |
| 2017/0268296 | A1 | 9/2017 | Gledhill et al. | |
| 2017/0284161 | A1 | 10/2017 | Zhang | |
| 2018/0238170 | A1 | 8/2018 | Scharting et al. | |
| 2018/0274303 | A1 | 9/2018 | Song et al. | |
| 2019/0009390 | A1 | 1/2019 | Long et al. | |
| 2019/0263723 | A1 * | 8/2019 | Kasonde | C23F 1/02 |

FOREIGN PATENT DOCUMENTS

| | | | | |
|---|---|---|---|---|
| CA | 2983115 | A1 * | 12/2016 | E21B 10/42 |
| CA | 2983115 | A1 | 12/2016 | |
| EP | 0718462 | A2 * | 6/1996 | E21B 10/62 |
| EP | 0718462 | A2 | 6/1996 | |
| KR | 20120132679 | A * | 12/2012 | E21B 10/567 |
| KR | 20120132679 | A | 12/2012 | |
| WO | 2012145586 | A1 | 10/2012 | |
| WO | WO-2012145586 | A1 * | 10/2012 | B22F 7/08 |
| WO | WO-2015101638 | A1 * | 7/2015 | B22F 3/02 |
| WO | 2017081649 | A1 | 5/2017 | |
| WO | WO-2017081649 | A1 * | 5/2017 | E21B 10/567 |
| WO | WO-2017095714 | A1 * | 6/2017 | E21B 10/55 |

OTHER PUBLICATIONS

Non-Final Office Action for U.S. Appl. No. 15/669,655 dated Feb. 6, 2019.

Non-Final Office Action for U.S. Appl. No. 16/571,664 dated Jan. 29, 2021.

Non-Final Office Action for U.S. Appl. No. 16/571,664 dated Oct. 2, 2020.

Notice of Allowance for U.S. Appl. No. 15/669,655 dated Jun. 17, 2019.

Notice of Allowance for U.S. Appl. No. 16/571,664 dated Jul. 21, 2021.

U.S. Appl. No. 15/669,655, filed Aug. 4, 2017.

U.S. Appl. No. 62/232,732, filed Sep. 25, 2015.

* cited by examiner

MULTI-PART SUPERABRASIVE COMPACTS, ROTARY DRILL BITS INCLUDING MULTI-PART SUPERABRASIVE COMPACTS, AND RELATED METHODS

BACKGROUND

Wear-resistant, polycrystalline diamond compacts ('PDCs') are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ('HPHT') process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container or cartridge with a volume of diamond particles positioned on a surface of the cemented carbide substrate. A number of such cartridges may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ('PCD') table. Cobalt is often used as the catalyst material for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst. Once the PCD table is formed, the solvent catalyst may be at least partially removed from the PCD table of the PDC by acid leaching.

Despite the availability of a number of different PDCs, manufacturers and users of PDCs continue to seek PDCs that exhibit improved toughness, wear resistance, thermal stability, or combinations thereof.

SUMMARY

Embodiments disclosed are directed to a superabrasive compact including one or more superabrasive cutting portions or segments, rotary drill bits including one or more of the superabrasive compacts, and related methods (e.g., methods of fabricating and/or operating the superabrasive cutting elements). For example, the superabrasive compact may include polycrystalline diamond that may form at least a portion of a working surface of the superabrasive compact. In one or more embodiments, the superabrasive compact may include a mounting hub and a superabrasive cutting segment that may be connected to the mounting hub. For example, the superabrasive cutting segment may include thermally-stable polycrystalline diamond that may form or define at least a portion of the working surface and/or a cutting edge of the superabrasive compact.

An embodiment includes a superabrasive compact that includes a mounting hub including an upper surface, a lower surface, and a mounting feature including at least a portion of that includes a downward-facing taper. The superabrasive compact further includes a superabrasive cutting segment including an upper surface, a bottom surface, and a peripheral surface including a portion that exhibits a substantially complementary shape to at least a portion of the mounting feature. The downward-facing taper at least partially restricts axial movement of the superabrasive cutting segment relative to the mounting hub in an axial direction.

Another embodiment includes a PDC that includes a mounting hub including an upper surface, a lower surface, and a mounting feature. The mounting hub includes polycrystalline diamond. The PDC includes a superabrasive cutting segment including an upper surface, a bottom surface, and a peripheral surface including a portion that exhibits a substantially complementary shape to at least a portion of the mounting feature. The superabrasive cutting segment includes polycrystalline diamond that is more thermally stable than the polycrystalline diamond of the mounting hub. The mounting hub at least partially restricts movement of the superabrasive cutting element.

Embodiments also include a rotary drill bit that includes a bit body that includes a plurality of blades, and a plurality of superabrasive compacts secured to or integrated with at least one blade of the plurality of blades. At least one of the plurality of superabrasive compacts includes a mounting hub secured to the at least one blade and including a mounting feature, and a superabrasive cutting segment including a peripheral surface having at least a portion of that exhibits a substantially complementary shape to the mounting feature. The superabrasive cutting segment is secured to the at least one blade by the mounting hub.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1A:
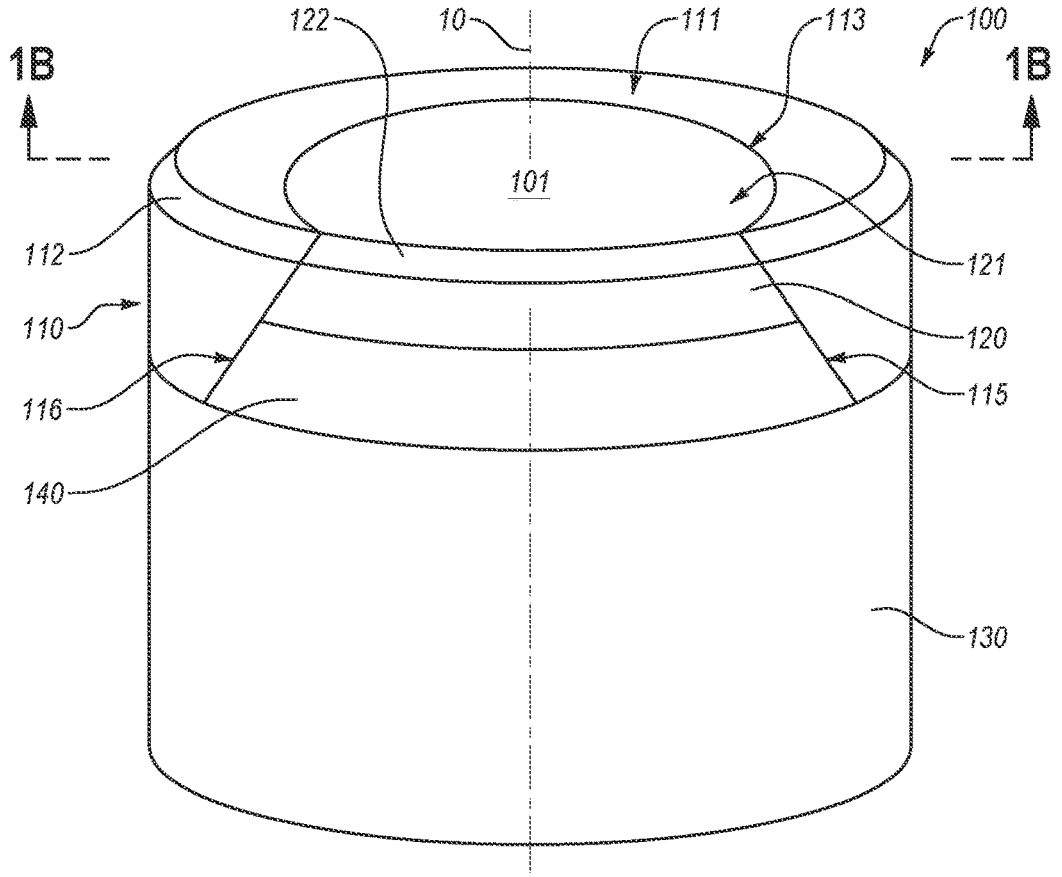
FIG. 1A is an isometric view of a superabrasive compact, according to an embodiment.

Embodiments disclosed are directed to a superabrasive compact including one or more superabrasive cutting portions or segments, rotary drill bits including one or more of the superabrasive compacts, and related methods (e.g., methods of fabricating and/or operating the superabrasive compacts). For example, the superabrasive compact may include polycrystalline diamond that may form at least a portion of a working surface of the superabrasive compact. In one or more embodiments, the superabrasive compact may include a mounting hub and a superabrasive cutting segment that may be connected to the mounting hub. For example, the superabrasive cutting segment may include thermally-stable polycrystalline diamond that may form or define at least a portion of the working surface and/or a cutting edge of the superabrasive compact.

In an embodiment, the superabrasive cutting segment may include superabrasive material (i.e., a material with a hardness exceeding a hardness of tungsten carbide), such as polycrystalline diamond (e.g., the superabrasive cutting segment may essentially include only polycrystalline diamond, such as a partially or substantially completely leached polycrystalline diamond table). Moreover, one or more portions of the mounting hub may include superabrasive material. For example, the mounting hub may be include polycrystalline diamond and may be bonded to a substrate. In some embodiments, the polycrystalline diamond of the mounting hub may be unleached and/or may include a selected amount or percent weight of catalyst material therein or other binder in interstitial regions thereof.

The mounting hub and the superabrasive cutting segment may include one or more connection or mounting features that may connect superabrasive cutting segment(s) to the mounting hub. For example, one or more portions of the superabrasive cutting segment(s) and the mounting feature(s) may have substantially complementary shapes and, when connected together, the mounting feature(s) may restrict relative movement between the mounting hub and the superabrasive cutting segment (e.g., lateral and/or axial). For example, the mounting feature(s) may interface and/or interlock together, such that the superabrasive cutting segment may be restricted from moving outward relative to an upper face of the mounting hub (e.g., such as to prevent the upper surface of the hub from being closer to the substrate than the upper surface of the superabrasive cutting segment(s)).

In an embodiment, the mounting feature(s) may facilitate securing a superabrasive cutting segment of thermally-stable polycrystalline diamond to the mounting hub (e.g., without cracking the thermally-stable polycrystalline diamond). Optionally, the mounting feature(s) may allow the superabrasive cutting segment to move axially away from the upper surface of the hub. In an embodiment, one or more support elements may be suitably positioned to support the superabrasive cutting segment in a manner that prevents or limits downward axial movement thereof. Under some operating conditions, certain stresses experienced by the superabrasive cutting segment may be reduced (e.g., as compared to a cutting segment brazed to a substrate).

FIG. 1A shows an isometric view of a superabrasive compact 100, according to an embodiment. The superabrasive compact 100 includes a mounting hub 110 and a superabrasive cutting segment 120 at least partially captured by, connected to, and/or secured to the mounting hub 110. In an embodiment, the superabrasive compact 100 includes a support element, such as a substrate 130 that may at least partially secure together the superabrasive cutting segment 120 and the mounting hub 110. For example, the substrate 130 may prevent or limit downward movement of the superabrasive cutting segment 120 relative to the mounting hub 110 (e.g., limiting movement of the superabrasive cutting segment 120 downward from an upper surface 111 of the mounting hub 110, such that an upper surface 121 of the superabrasive cutting segment 120 is recessed relative to the upper surface 111).

Generally, the superabrasive compact 100 includes a working upper surface 101 and a cutting edge that may be defined by and between the upper surface 101 and a peripheral surface extending thereto. In an embodiment, at least a portion of the upper surface 101 may be defined or formed by the upper surface 121 of the superabrasive cutting segment 120. For example, a portion of the upper surface 101 may be defined by the upper surface 121 and another portion of the upper surface 101 may be defined by the upper surface 111 of the mounting hub 110.

In an embodiment, the superabrasive compact 100 may include a cutting edge. For example, the cutting edge may include and/or may be at least partially defined by a chamfer.

In the illustrated embodiment, the superabrasive cutting segment 120 includes a chamfer 122 extending about a portion of the periphery thereof (e.g., the chamfer may extend about an exposed portion of the periphery of the superabrasive cutting segment 120, which is at least partially exposed out of the mounting hub 110 and/or forms a portion of the cutting edge of the superabrasive compact 100). Additionally or alternatively, the periphery of the mounting hub 110 may include a chamfer 112 (e.g., extending between the upper surface 111 and the peripheral surface of the mounting hub 110). In an embodiment, the chamfer 112 of the mounting hub 110 may be substantially the same dimensions and configuration as the chamfer 122 of the superabrasive cutting segment 120. Alternatively, the superabrasive cutting segment 120 may have a larger chamfer 122 than the chamfer 112 of the mounting hub 110, or vice versa (e.g., a smaller chamfer 122 on the superabrasive cutting segment 122 may result in more aggressive cutting during operation).

In the illustrated embodiment, the upper surface 101 is substantially planar and has a substantially circular periphery or perimeter. It should be appreciated, however, that the upper surface 101 may have any number of suitable shapes and configurations, which may vary from one embodiment to the next. For example, the upper surface 101 may be dome-shaped, conical, concave, etc. Moreover, the upper surface 101 may have a rectangular, polygonal, or any other suitable perimeter shape.

In an embodiment, the superabrasive compact 100 may include an intermediate supporting element 140, which may support, at least partially contact, or about a bottom surface of the superabrasive cutting segment 120. For example, the substrate 130 may position the intermediate supporting element 140 adjacent to or against the bottom surface of the superabrasive cutting segment 120. Additionally or alternatively, the intermediate supporting element 140 may be bonded to the substrate 130 and/or superabrasive cutting segment 120 (e.g., brazed, welded, etc.). In one or more embodiments, the mounting hub 110, superabrasive cutting segment 120, substrate 130, intermediate supporting element 140, or combinations thereof may be bonded together at one or more portions or surfaces that are in at least partial contact with one another, as described below in more detail. For example, a TiCuSil braze alloy or other suitable braze alloys may be used to braze together the mounting hub 110, superabrasive cutting segment 120, substrate 130, intermediate supporting element 140, or combinations thereof. In some embodiments, brazing may be performed in an inert or partially inert environment, such as by vacuum brazing or brazing under an argon atmosphere. In any of the embodiments disclosed herein, the bonding agents disclosed in U.S. Pat. No. 9,255,312 may be used to bond together the mounting hub 110, superabrasive cutting segment 120, substrate 130, intermediate supporting element 140, or combinations thereof. The disclosure of U.S. Pat. No. 9,255,312 is incorporated herein by this reference, in its entirety.

Additional or alternative braze alloys include gold alloys, silver alloys, copper alloys, or titanium alloys, among others. In an embodiment, braze alloy comprise an alloy of about 4.5 weight % titanium, about 26.7 weight % copper, and about 68.8 weight % silver, otherwise known as TICUSIL®, which is currently commercially available from Wesgo Metals, Hayward, Calif. In an embodiment, a braze alloy may comprise an alloy of about 25 weight % gold, about 37 weight % copper, about 10 weight % nickel, about 15 weight % palladium, and about 13 weight % manganese, otherwise known as PALNICUROM® 10, which is also currently commercially available from Wesgo Metals, Hayward, Calif. Another suitable braze alloy may include about 92.3 weight % nickel, about 3.2 weight % boron, and about 4.5 weight % silicon. Yet another suitable braze alloy may include about 92.8 weight % nickel, about 1.6 weight % boron, and about 5.6 weight % silicon. Moreover, various elements and/or components of the superabrasive compact 100 can be brazed together in a vacuum environment (e.g., in a vacuum furnace or induction furnace), as described more fully in U.S. Pat. No. 8,727,044, the entire disclosure of which is incorporated herein by this reference.

In some embodiments, braze between the superabrasive cutting segment 120 and intermediate supporting element 140 may be formed from a disk or foil of suitable braze material, which may be inserted between superabrasive cutting segment 120 and the intermediate supporting element 140 during the fabrication of the superabrasive compact 100. For example, a disk of braze material may be placed between the superabrasive cutting segment 120 and intermediate supporting element 140 and may be heated to bond together the superabrasive cutting segment 120 and the intermediate supporting element 140.

The mounting hub 110 may have a mounting feature 113 (e.g., an opening or channel) within which the superabrasive cutting segment 120 may be positioned and/or which may secure, position, or at least partially restrain, the superabrasive cutting segment 120 relative to the mounting hub 110. Generally, at least a portion of peripheral surface 123 (see FIG. 1B) of the superabrasive cutting segment 120 and the interior surface that defines the opening mounting feature 113 of the mounting hub 110 may have complementary shapes and sizes, such that the superabrasive cutting segment 120 may be inserted into and/or positioned within the mounting feature 113 and/or vice versa. In some embodiments, at least a portion of the peripheral surface 123 of the superabrasive cutting segment 120 may have a downward-facing taper (as shown in FIGS. 1A-1B), and at least a corresponding portion of the mounting feature 113 may have a complementary taper to the tapered portion(s) of the superabrasive cutting segment 120.

For example, when the superabrasive cutting segment 120 is coupled with the mounting feature 113 of the mounting hub 110, the downward-facing taper may prevent outward movement of the superabrasive cutting segment 120 relative to the mounting hub 110 (e.g., prevent or limit movement of the upper surface 121 outward relative to the upper surface 111, in a manner that the upper surface 121 would protrude past the upper surface 111).

Figure 1B:
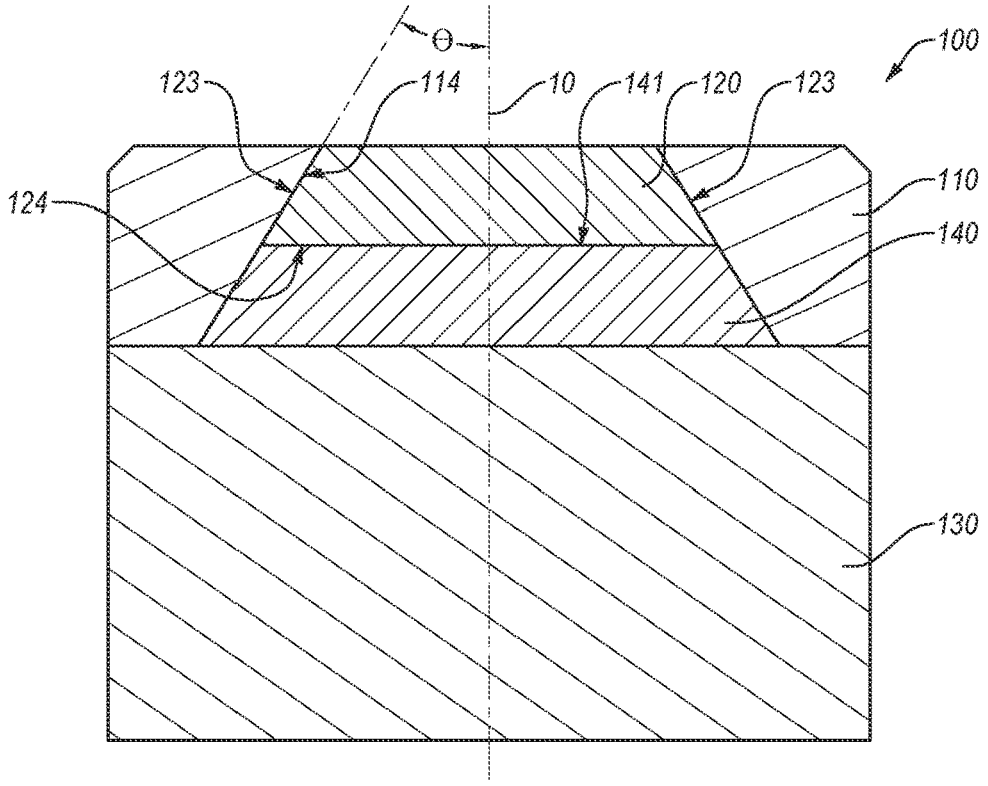
FIG. 1B is a cross-sectional view of the superabrasive compact of FIG. 1A.

The downward-facing taper may have any suitable angle θ as shown in FIG. 1B (e.g., any suitable included angle or any suitable angle relative to a vertical or longitudinal axis 10 of the superabrasive compact 100). In an embodiment, the taper may be a locking taper, such that the superabrasive cutting segment 120 may be retained inside the mounting feature 113 by the friction and/or interference therebetween (e.g., angle θ may be about 1° to about 5°, 5°-10°, 10°-15°, or 15°-25°). Alternatively, the taper may have a release angle, such that superabrasive cutting segment 120 may freely move (if not otherwise secured) relative to the mounting hub 110 (e.g., such that the upper surface 121 moves downward from the upper surface 111).

It should be appreciated, however, that one or more portions of the peripheral surface 123 of the superabrasive cutting segment 120 may be substantially cylindrical or without a taper (e.g., the surface(s) may be substantially parallel to the longitudinal axis 10 of the superabrasive compact 100 and/or substantially perpendicular to the upper surface 121). Moreover, the mounting feature 113 may be defined by substantially frusto-conical inside surfaces that may be obliquely angled relative to the longitudinal axis 10, such as to define a shape that is substantially complementary to the shape of the peripheral surface 123 of the superabrasive compact 120.

Generally, the superabrasive cutting segment 120 and/or the mounting feature 113 of the mounting hub 110 may have any suitable cross-sectional shape (e.g., at a cross-section taken perpendicular to the longitudinal axis 10). In the illustrated embodiment, the superabrasive cutting segment 120 and mounting feature 113 have arcuate cross-sectional shapes. In particular, for example, one or more portions of the cross-sectional shape of the superabrasive cutting segment 120 and/or mounting feature 113 may be semi-circular. In an embodiment, a portion of the cross-sectional shape of the superabrasive cutting segment 120 and/or the mounting feature 113 may have a first radius, while another portion of the superabrasive cutting segment 120 and/or mounting feature 113 may have a second radius, which may be different from the first radius (e.g., the portion of the superabrasive cutting segment 120 that is in contact with the mounting hub 110 may have a first radius, and the portion of the superabrasive cutting segment 120 that is exposed out of the mounting hub 110 may have a second radius that is less than or greater than the first radius). For example, the portion of the peripheral surface of the superabrasive cutting segment 120 that extends between edges 115 and 116 of the mounting hub 110 may coincide with a portion of an imaginary cylindrical surface, while the portion of the peripheral surface of the superabrasive cutting segment that is adjacent to the mounting feature 113 may be angled and at least a portion thereof may coincide with a portion of an imaginary conical surface.

It should be appreciated that the radii of the superabrasive cutting segment 120 and/or of the mounting feature 113 may be different or may change at different cross-sections along the longitudinal axis 10 (e.g., the radii may increase from a cross-section located closer to the upper surface 101 to another cross-section located farther from the upper surface 101). In other words, tapered portions of the superabrasive cutting segment 120 and/or mounting feature 113 may be defined by changing radii from one cross-section to another cross-section along the longitudinal axis 10.

In an embodiment, the mounting feature 113 may have an open side (e.g., the mounting feature 113 may be generally channel-shaped or may form a recess), such that a portion of the superabrasive cutting segment 120 may protrude out of or may be exposed, as described above. For example, the open side of the mounting feature 113 may be defined by edges or sides 115, 116. More specifically, as shown in FIG. 1A, a portion of the peripheral surface of the superabrasive cutting segment 120 and the peripheral surface of the mounting hub 110 may lie on or coincide with the same imaginary cylindrical surface (e.g., the peripheral surface of the mounting hub 110 may terminate at the edges 115, 116 and the peripheral surface of the superabrasive cutting segment 120 may extend substantially between the edges 115 and 116).

Furthermore, the superabrasive cutting segment 120 and the mounting feature 113 may be shaped in order to prevent or limit lateral movement of the superabrasive cutting segment 120 relative to the mounting hub 110 (e.g., in a direction substantially perpendicular to the longitudinal axis 10 and outward and/or in a substantially plane parallel to the upper surface 101). For example, the mounting feature 113, which extends between the edges 115, 116, may retain the superabrasive cutting segment 120 substantially fixed in the lateral direction relative to the mounting hub 110. As described below in more detail, the superabrasive cutting segment 120 and/or mounting feature 113 may have any number of suitable shapes that may be configured to restrain the superabrasive cutting segment 120 relative to the mounting hub 110 in the lateral direction, such that a portion of the superabrasive cutting segment 120 may protrude beyond the peripheral surface of the mounting hub 110 and/or may extend between edges defining an open side of the mounting feature 113 in the mounting hub 110, while maintaining the superabrasive cutting segment 120 substantially affixed relative to the mounting hub 110 in the lateral direction.

For example, the superabrasive cutting segment 120 may be inserted into the mounting feature 113 of the mounting hub 110 (e.g., from a back side), and the peripheral surface 123 of the superabrasive cutting segment 120 may be positioned near and/or at least partially contacting the inner surface defining the mounting feature 113 in a manner that limits or prevents the superabrasive cutting segment 120 from moving outward relative to the upper surface 111. In some embodiments, as mentioned above, the superabrasive cutting segment 120 may be substantially restrained from moving downward (e.g., to prevent recessing the upper surface 121 relative to the upper surface 111). For example, the substrate 130 and/or the intermediate supporting element 140 may position or bias the superabrasive cutting segment 120 against the taper of the mounting feature 113, thereby securing the superabrasive cutting segment 120 relative to the mounting hub 110.

In some embodiments, one or more surfaces of the superabrasive cutting segment 120 may be bonded to one or more corresponding or adjacent surfaces. For example, as shown in FIG. 1B, a bottom surface 124 of the superabrasive cutting segment 120 may be brazed to a top surface 141 of the intermediate supporting element 140. Additionally or alternatively, at least a portion of the peripheral surface 123 of the superabrasive cutting segment 120 may be brazed to an inner surface 114 (that defines the opening mounting feature 113 (FIG. 1A)) of the mounting hub 110. Furthermore, in an embodiment, the mounting hub 110 and/or the intermediate supporting element 140 may be brazed to the substrate 130 at an interface therebetween. For example, brazing together the mounting hub 110, substrate 130, and intermediate supporting element 140 may together securely affix the superabrasive cutting segment 120 relative to one another other.

In at least one embodiment, the superabrasive cutting segment 120 may be unbonded from or may have no metallurgical bond with the mounting hub 110 and/or intermediate supporting element 140. For example, the superabrasive cutting segment 120 may be positioned adjacent to (e.g., pressed into) the mounting feature 113 and the downward-facing taper may limit or prevent movement of the superabrasive cutting segment 120 upwardly outward relative to the upper surface 111. Moreover, the substrate 130 and/or intermediate supporting element 140 may prevent movement of the superabrasive cutting segment 120 downward (e.g., inward in the mounting feature 113).

In an embodiment, the superabrasive cutting segment 120 and/or mounting hub 110 may comprise polycrystalline diamond and the substrate 130 may comprise a cemented carbide. For example, substrate 130 may comprise tungsten carbide, tantalum carbide, vanadium carbide, niobium carbide, chromium carbide, titanium carbide, or combinations of the foregoing carbides cemented with at least one cementing constituent, such as iron, nickel, cobalt, or alloys thereof (e.g., cobalt-cemented tungsten carbide). In an embodiment, the mounting hub 110 itself may comprise a polycrystalline diamond compact including a polycrystalline diamond table integrally formed with a cobalt-cemented tungsten carbide substrate, the polycrystalline diamond table defining the upper surface 111 of the mounting hub. Furthermore, in any of the embodiments disclosed herein, the polycrystalline diamond table (e.g., the, superabrasive cutting segment 120 and/or mounting hub 110) may be exhibit a thickness of about 0.0500 inches to about 0.500 inches, such as about 0.080 inches to about 0.100 inches, or about 0.080 inches to about 0.150 inches. Furthermore, in any of the embodiments disclosed herein, the polycrystalline diamond table (e.g., the, superabrasive cutting segment 120 and/or mounting hub 110) may be leached to at least partially remove or substantially completely remove a metal-solvent catalyst (e.g., cobalt, iron, nickel, or alloys thereof) that was used to initially sinter precursor diamond particles to form the polycrystalline diamond. In other embodiments, the polycrystalline diamond table may comprise another type of thermally-stable polycrystalline diamond material. In another embodiment, an infiltrant used to re-infiltrate a preformed leached polycrystalline diamond table may be leached or may otherwise be removed to a selected depth from a working surface. Moreover, in any of the embodiments disclosed herein, the polycrystalline diamond may be un-leached and include a metal-solvent catalyst (e.g., cobalt, iron, nickel, or alloys thereof) that was used to initially sinter the precursor diamond particles that form the polycrystalline diamond and/or an infiltrant (e.g., a braze material) used to re-infiltrate a preformed leached polycrystalline diamond table. Examples of methods for fabricating superabrasive cutting segments and superabrasive materials and/or structures from which the superabrasive cutting segments may be made are disclosed in U.S. Pat. Nos. 7,866,418; 7,998,573; 8,034,136; and 8,236,074; the disclosure of each of the foregoing patents is incorporated herein, in its entirety, by this reference.

The diamond particles that may be used to fabricate the superabrasive table in a high-pressure/high-temperature process ("HPHT") may exhibit a larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 70 μm, 60 μm, 50 μm, 40 μm, 30 μm, 20 μm, 16 μm, 15 μm, 12 μm, 10 μm, 8 μm) and another portion exhibiting at least one relatively smaller size (e.g., 15 μm, 12 μm, 10 μm, 8 μm, 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and 4 μm. In another embodiment, the diamond particles may include a portion exhibiting the relatively larger size between about 15 μm and about 50 μm and another portion exhibiting the relatively smaller size between about 5 μm and about 15 μm. In another embodiment, the relatively larger size diamond particles may have a ratio to the relatively smaller size diamond particles of at least 1.5. In some embodiments, the diamond particles may comprise three or more different sizes (e.g., one relatively larger size and two or more relatively smaller sizes), without limitation. The resulting polycrystalline diamond formed from HPHT sintering the aforementioned diamond particles may also exhibit the same or similar diamond grain size distributions and/or sizes as the aforementioned diamond particle distributions and particle sizes. Additionally, in any of the embodiments disclosed herein, the superabrasive cutting segments may be free-standing (e.g., substrateless) and/or formed from a polycrystalline diamond body that is at least partially or substantially leached to remove a metal-solvent catalyst initially used to sinter the polycrystalline diamond body.

In some embodiments, the superabrasive cutting segment 120 may be at least partially more thermally stable then the mounting hub 110 (e.g., superabrasive cutting segment 120 may be leached, while the mounting hub 110 may be at least partially or substantially unleached or leached to a lesser degree than the superabrasive cutting segment 120). In an embodiment, the mounting hub 110 may include polycrystalline diamond having a first average diamond grain size and the superabrasive cutting segment 120 may include polycrystalline diamond having a second average diamond grain size (e.g., the mounting hub 110 may include polycrystalline diamond that has a larger average diamond grain size than the superabrasive cutting segment 120), or vice versa. Additionally or alternatively, the mounting hub 110 may include an unpolished upper surface 111, and the superabrasive cutting segment 120 may include a polished upper surface 121 (e.g., the upper surface 111 may have a greater roughness than the upper surface 121), or vice versa.

In some embodiments, the mounting hub 110 and/or the superabrasive cutting segment 120 may include a single layer of polycrystalline diamond or multiple layers. For example, the mounting hub 110 may include a multiple layers of superabrasive material (e.g., polycrystalline diamond, polycrystalline boron nitride, silicon carbide, non-diamond ceramics, etc.) and the superabrasive cutting segment 120 may include a single layer (e.g., thermally-stable polycrystalline diamond), or vice versa. In at least one embodiment, the mounting hub 110 may include multi-layered unleached polycrystalline diamond, and the superabrasive cutting segment 120 may include a thermally-stable or at least partially leached multi-layered polycrystalline diamond. In some embodiments, the mounting hub 110 and the superabrasive cutting 120 may include polycrystalline diamond (e.g., the superabrasive cutting segment 120 may include polycrystalline diamond that is more thermally stable than the polycrystalline diamond of the mounting hub 110).

Additionally or alternatively, the superabrasive cutting segment 120 may be fabricated or manufactured at a higher pressure than the mounting hub 110 that includes polycrystalline diamond. For example, the superabrasive cutting segment 120 may be fabricated at a cell pressure of at least 7.5 GPa (e.g., about 7.5 GPa to about 15 GPa), and the mounting hub 110 may be fabricated at a cell pressure below 7.5 GPa. In some embodiments, the superabrasive cutting segment 120 may exhibit a coercivity of 115 Oe or more, a high-degree of diamond-to-diamond bonding, a specific magnetic saturation about 15 $G \cdot cm^3/g$ or less, and a metal-solvent catalyst content of about 7.5 weight % ("wt %") or less. Magnetic and other physical properties for the superabrasive cutting segment 120 fabricated at a cell pressure of at least 7.5 GPa are disclosed in U.S. Pat. No. 7,866,418, which was previously incorporated herein by reference.

For example, the superabrasive cutting segment 120 may have lower residual stresses than the mounting hub 110 (e.g., lower residual compressive stresses) when the superabrasive cutting segment 120 is formed at a cell pressure greater than 7.5 GPa and the mounting hub 110 is formed at a cell pressure less than 7.5 GPa. Such a configuration may cause less catalyst material to be present in the superabrasive cutting segment 120 than in the mounting hub 110; hence, the cutting segment 120 may exhibit a higher thermal stability than mounting hub 110. In an embodiment, mounting and/or brazing the superabrasive compact 100 to a holder (e.g., to a drill bit, a support ring of a bearing assembly, etc.) may introduce stress with substrate 130 and/or mounting hub 110 (e.g., during brazing, as one or more portions of the superabrasive compact 100 expands). However, the mounting hub 110 and/or the substrate 130, may be more resistant to liquid metal embrittlement cracking during brazing than a superabrasive cutting segment 120 (e.g., formed at cell pressures greater than 7.5 GPa). In an embodiment, because a majority of the peripheral surface 123 of the superabrasive cutting segment 120 is surrounded by the mounting hub 110, liquid metal embrittlement cracking during brazing may be reduced and/or eliminated in the superabrasive compact 100.

Moreover, in at least one embodiment, the mounting hub 110 may include non-polycrystalline diamond material. Suitable materials include tungsten carbide and/or tungsten carbide impregnated and/or cemented with one or more materials, such as cobalt, nickel, brass, combinations thereof, etc. Additional or alternative materials for the mounting hub 110 include cubic boron nitride ("CBN"), silicon nitride, alumina, titanium diboride, matrix material, ceramic tape, etc. In one or more embodiments, the mounting hub 110 may include a non-superabrasive material, such as steel. In at least one embodiment, the upper surface 111 of the mounting hub 110 may include and/or may be defined by a coating, such as a TiN, TiC, TiCN, hardfacing, diamond-like carbon ("DLC"), CVD diamond, SiC, SiN, any metal carbide, WC, TiAlN, or combinations thereof, etc.

The intermediate supporting element 140 may also include any number of suitable materials, such as one or more of the materials identified above in connection with the mounting hub 110 and the superabrasive cutting segment 120. For example, the intermediate supporting element 140 may comprise polycrystalline diamond that may be integrally formed with the substrate 130. For example, the intermediate supporting element 140 may comprise similar material as the superabrasive cutting segment 120 or the mounting hub 110.

As described above, the substrate 130 may comprise tungsten carbide, such as cobalt-cemented tungsten carbide. For example, the substrate 130 may be preformed and have any suitable shape and/or size. In some embodiments, the substrate 130 may include non-superabrasive material(s), such as steel.

It should be appreciated that the superabrasive compact 100 (and any superabrasive cutting element described herein) may include any suitable combination of materials for the mounting hub 110, superabrasive cutting segment 120, substrate 130, intermediate supporting element 140, and combinations thereof, which may vary from one embodiment to the next. In some embodiments, the superabrasive cutting segment 120 may, generally, include material that has higher wear resistance (e.g., abrasion resistance, impact resistance, thermal stability etc.) than material(s) of other elements or components of the superabrasive compact 100, such as material of the mounting hub 110, and may be more expensive to manufacture than such materials.

The superabrasive compact 100 may be fabricated in any number of suitable way and/or with any number of suitable manufacturing techniques and processes. For example, the mounting hub 110, the superabrasive cutting segment 120, the intermediate supporting element 140, or combinations thereof may be machined (e.g., electro-discharged machined ("EDM'd"), wire EDM'd, laser cut, laser ablated, ground, etc.) from a polycrystalline diamond compact including a polycrystalline diamond table integrally formed with a substrate or from a polycrystalline table (e.g., unleached). In an embodiment, the mounting hub 110, the superabrasive cutting segment 120, the intermediate supporting element 140, or combinations thereof may be formed by rapid prototyping (e.g., 3-D printing, laser deposition manufacturing, IR beam deposition manufacturing, etc.). Moreover, as described above, the mounting hub 110, the superabrasive cutting segment 120, the intermediate supporting element 140, or combinations thereof may be brazed together. In an embodiment, the wire diameter may be selected such as to accommodate a suitable amount and/or thickness of brazing material between the mating or bonding surfaces of the mounting hub 110, the superabrasive cutting segment 120, the intermediate supporting element 140, or combinations thereof.

Moreover, the mounting hub 110 may be fabricated from a used or a partially worn polycrystalline diamond compact or bearing element including a polycrystalline diamond table integrally formed with a substrate. For example, the portion(s) of the worn polycrystalline diamond element can be cut away or removed to form one or more mounting features of the mounting hub 110. The superabrasive cutting segment 120 can be fabricated from a used and/or worn cutting or bearing element. According to one or more embodiments, fabrication of superabrasive compact 100 may include reusing and/or recycling of existing worn polycrystalline diamond elements.

Figure 2:
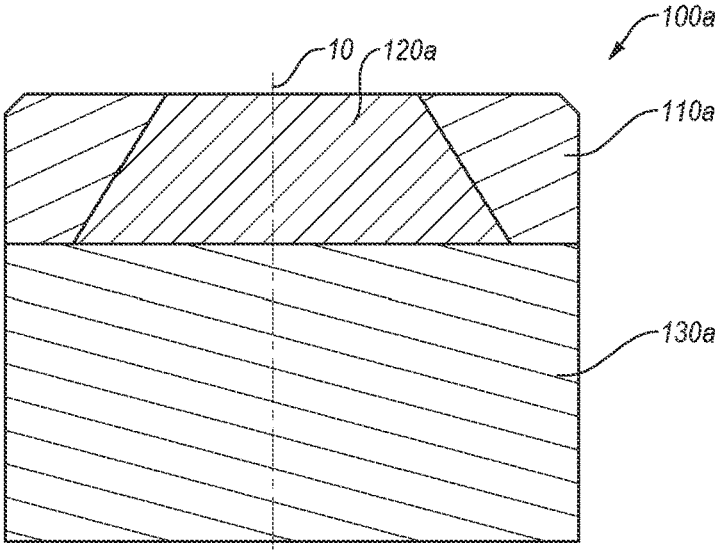
FIG. 2 is a cross-sectional view of a superabrasive compact, according to an embodiment.

As mentioned above, the superabrasive cutting segment may be positioned, or pressed, or press-fit into the opening in the hub by the support element without any intervening elements therebetween. FIG. 2 is a cross-sectional view of a superabrasive compact 100*a*, according to an embodiment. In some embodiments, the superabrasive compact 100*a* and its materials, features, elements, or components may be similar to or the same as the superabrasive compact 100 (FIGS. 1A-1B) and its corresponding material, features, elements, and components. For example, the superabrasive compact 100*a* may include mounting hub 110*a* and superabrasive cutting segment 120*a* at least partially secured to the mounting hub 110*a* by the mounting feature(s) thereof. The superabrasive compact 100*a* may include a substrate 130*a* that may position and/or secure the superabrasive cutting segment 120*a* at least partially in the mounting hub 110*a*. The materials, features, elements, components, described above with respect to mounting hub 110*a*, superabrasive cutting segment 120*a*, or substrate 130*a* may be similar to or the same as the materials, features, elements, components, described above with respect to mounting hub 110, superabrasive cutting segment 120, and substrate 130 of the superabrasive compact 100 (FIGS. 1A-1B).

In some embodiments, the superabrasive cutting segment 120*a* may have substantially the same thickness as the mounting hub 110*a*. Moreover, in an embodiment, the substrate 130*a* may have a substantially planar upper surface that may at least partially contact a bottom surface of the mounting hub 110*a* and superabrasive cutting segment 120*a*, thereby positioning the superabrasive cutting segment 120*a* into and/or relative to the mounting feature(s) of the mounting hub 110*a* and/or securing together the mounting hub 110*a* and/or superabrasive cutting segment 120*a*. In alternative or additional embodiments, the upper surface of the substrate 130*a* may be non-planar (e.g., patterned, such as to have ridges, indentations, etc., to be concave, convex, irregularly shaped, etc.). As described above, the mounting hub 110*a*, superabrasive cutting segment 120*a*, substrate 130*a*, or combinations thereof may be brazed together or otherwise secured together (e.g., metallurgically) at one or more interfaces therebetween (e.g., at adjacent surfaces thereof).

Figure 3:
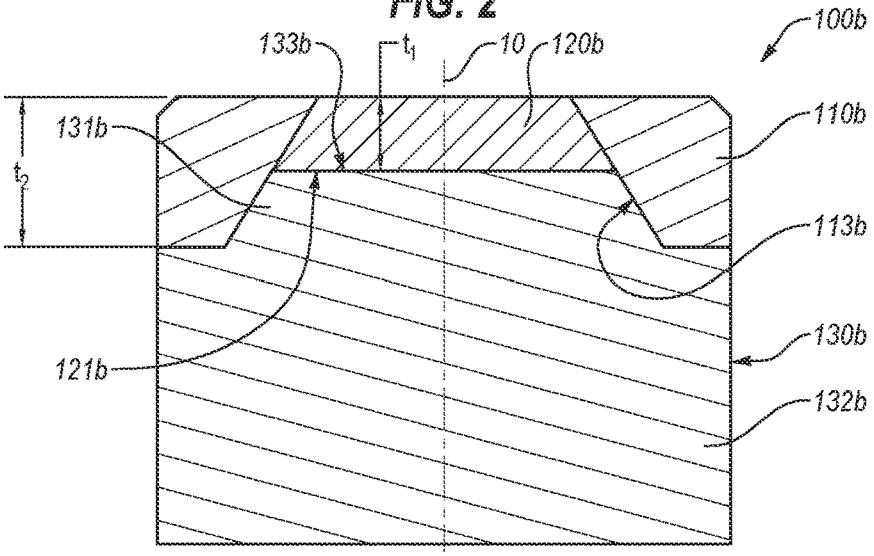
FIG. 3 is a cross-sectional view of a superabrasive compact, according to another embodiment.

Generally, the superabrasive cutting segment and/or the mounting hub may have any suitable thickness. For example, the superabrasive cutting segment may be thinner than the hub or vice versa (e.g., as shown in FIGS. 1A-1B and described above). FIG. 3 illustrates a superabrasive compact 100*b* according to an embodiment. In some embodiments, the superabrasive compact 100*b* and its materials, features, elements, or components may be similar to or the same as the any of the superabrasive compacts 100, 100*a* (FIGS. 1A-2) and their corresponding materials, features, elements, and components. For example, the superabrasive compact 100*b* may include mounting hub 110*b* and superabrasive cutting segment 120*b* at least partially secured to assembled with, or positioned by the mounting hub 110*b* by mounting feature 113*b* thereof. The superabrasive compact 100*b* may include a substrate 130*b* positioning the superabrasive cutting segment 120*b* at least partially in the mounting hub 110*b*. The materials, features, elements, components, described above with respect to mounting hub 110*b*, superabrasive cutting segment 120*b*, or substrate 130*b* may be similar to or the same as the mounting hub 110, superabrasive cutting segment 120, substrate 130 (FIGS. 1A-1B).

In the illustrated embodiment, the superabrasive cutting segment 120*b* has a smaller thickness $t_1$ than the thickness $t_2$ mounting hub 110*b*. For example, a portion of the substrate 130*b* may extend into the opening in the mounting hub 110*b* to press and secure the superabrasive cutting segment 120*b* into the mounting feature 113*b* of the superabrasive cutting segment 120*b*. For example, the substrate 130*b* may have a protrusion 131*b* extending outward from a base 132*b*. In an embodiment, the protrusion 131*b* may generally have any suitable peripheral shape that may be sized and configured to fit partially into the mounting feature 113*b* of the mounting hub 110*b*.

For example, the protrusion 131*b* may be shaped and sized such that the peripheral surface thereof may contact and/or may be positioned adjacent to an interior surface defining the mounting feature 113*b* of the mounting hub 110*b* (e.g., a portion of the peripheral surface of the substrate 130*b*, such as at least a portion of the peripheral surface of the protrusion 131*b*, may have a substantially complementary shape to at least a portion of the surface that defines the mounting feature 113*b*). As mentioned above, in some embodiments, the mounting feature 113*b* may include one or more tapered portions. The peripheral surface of the protrusion 131*b* may have one or more corresponding tapered portions. In an embodiment, the protrusion 131*b* may be sized such as to form or define a space between the peripheral surface thereof and the interior surface defining the mounting feature 113*b* (e.g., such that the substrate 130*b* is positioned inside the mounting feature 113*b* in the mounting hub 110*b* without contact between one or more portions of the peripheral surface of the protrusion 131*b* and the interior surface of the mounting feature 113*b*).

Furthermore, in some embodiments, an upper surface 133*b* of the protrusion 131*b* may be sized and/or configured to be substantially the same as a bottom surface 121*b* of the superabrasive cutting segment 120*b*. For example, the protrusion 131*b* may support the superabrasive cutting segment 120*b* relative to the mounting feature 113*b* of the mounting hub 110*b*, such that the bottom surface 121*b* of superabrasive cutting segment 120*b* does not extend beyond the upper surface 133*b* of protrusion 131*b*. In an embodiment, the mounting hub 110*b*, superabrasive cutting segment 120*b*, and substrate 130*b* may collectively define a substantially solid assembly (e.g., substantially without voids in superabrasive compact 100*b*). For example, the mounting hub 110*b*, superabrasive cutting segment 120*b*, substrate 130*b*, or combinations thereof may be assembled together to define a substantially solid superabrasive compact 100*b* that may be substantially cylindrical.

Moreover, as described above, the mounting hub 110*b*, superabrasive cutting segment 120*b*, substrate 130*b*, or combinations thereof may be brazed together at one or more interfaces therebetween. For example, any voids present before brazing may be filled by the braze material that may metallurgically bond together the mounting hub 110*b*, superabrasive cutting segment 120*b*, and/or substrate 130*b*. In an embodiment, the superabrasive compact 100*b* may include at least one braze layer bonding together and/or spacing apart the superabrasive cutting segment, mounting hub, intermediate supporting element, support element, or combinations thereof.

Figure 4:
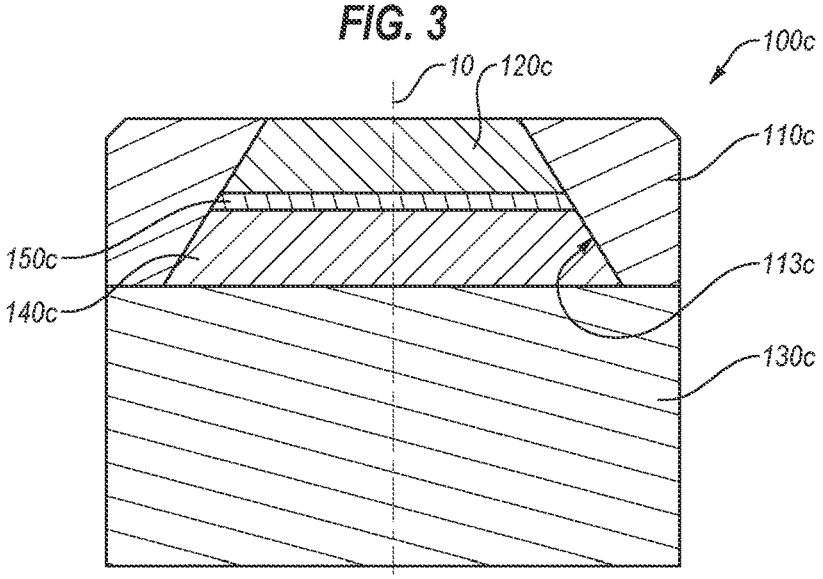
FIG. 4 is a cross-sectional view of a superabrasive compact, according to yet another embodiment.

FIG. 4 illustrates a superabrasive compact 100*c* according to an embodiment. In some embodiments, the superabrasive compact 100*c* and its materials, features, elements, or components may be similar to or the same as the any of the superabrasive compacts 100, 100*a*, 100*b* (FIGS. 1A-3) and their corresponding materials, features, elements, and components. For example, the superabrasive compact 100*c* may include mounting hub 110*c*, superabrasive cutting segment 120*c*, substrate 130*c*, and intermediate supporting element 140*c*, which may be similar to or the same as the mounting hub 110, superabrasive cutting segment 120, substrate 130, and intermediate supporting element 140 of the superabrasive compact 100 (FIGS. 1A-1B).

In some embodiments, the superabrasive compact 100*c* may include a deformable material 150*c* (e.g., a relatively soft material layer) positioned between the superabrasive cutting segment 120*c* and the intermediate supporting element 140*c*. For example, the deformable material 150*c* may include material that may be softer than the material of the superabrasive cutting segment 120*c* and/or of the intermediate supporting element 140*c*. Generally, any number of suitable materials may be used in the deformable material 150*c*, such as brass, copper, aluminum, tin, steel, combinations of the foregoing, alloys of the foregoing, etc. Moreover, the deformable material 150*c* may have any suitable thickness.

In an embodiment, the deformable material 150*c* may be formed by and/or may include a braze material. For example, the deformable material 150*c* may bond together the superabrasive cutting segment 120*c* and the intermediate supporting element 140*c*. Alternatively or additionally, the deformable material 150*c* may be bonded to the superabrasive cutting segment 120*c* and to the substrate 130*c*. In at least one embodiment, the deformable material 150*c* may secure together (e.g., bond together) the superabrasive cutting segment 120*c*, the mounting hub 110*c*, and the substrate 130*c*.

In some embodiments, the superabrasive cutting segment 120*c*, the deformable material 150*c*, and intermediate supporting element 140*c* may be unbonded one from another (e.g., in contact with one another, but without metallurgical bonding therebetween). For example, the substrate 130*c* may be bonded to the mounting hub 110*c* and may press or position the intermediate supporting element 140*c*, deformable material 150*c*, and/or superabrasive cutting segment

120*c* into mounting feature 113*c* of the mounting hub 110*c*. Such a configuration may secure the superabrasive cutting segment 120*c* relative to the mounting hub 110*c*. In an embodiment, the material of the deformable material 150*c* may be resilient (e.g., may be at least partially elastically deformable during operation of the superabrasive compact 100*c*). For example, the deformable material 150*c* may allow the superabrasive cutting segment 120*c* to move downward and/or toward the substrate 130*c* of the superabrasive compact 100*c*.

Under some operating conditions, the upper surface of the superabrasive cutting segment 120*c* may be below the upper surface of the mounting hub 110*c* (e.g., when a selected pressure or force is applied to the superabrasive cutting segment 120*c*), and the deformable material 150*c* may be at least partially elastically deformed and/or compressed. Hence, for example, when the deformable material 150*c* is compressed during operation and the applied force is removed or reduced, the deformable material 150*c* may bias the superabrasive cutting segment 120*c* upward, such that the upper surface of the superabrasive cutting segment 120*c* is substantially coplanar with the upper surface of the mounting hub 110*c*.

Figure 5:
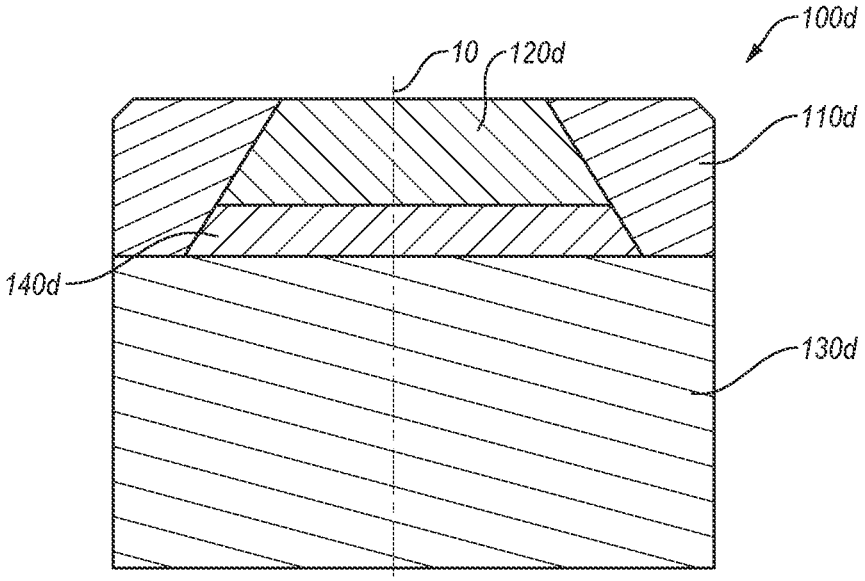
FIG. 5 is a cross-sectional view of a superabrasive compact, according to one or more additional or alternative embodiments.

As described above, the mounting hub and the superabrasive cutting segment may have any number of suitable thicknesses and/or relative thicknesses, which may vary from one embodiment to the next. FIG. 5 illustrates a superabrasive compact 100*d* according to an embodiment. In some embodiments, the superabrasive compact 100*d* and its materials, features, elements, or components may be similar to or the same as the any of the superabrasive compacts 100, 100*a*, 100*b*, 100*c* (FIGS. 1A-4) and their corresponding materials, features, elements, and components. For example, the superabrasive compact 100*d* may include mounting hub 110*d*, superabrasive cutting segment 120*d*, substrate 130*d*, and intermediate supporting element 140*d*, which may be similar to or the same as the mounting hub 110, superabrasive cutting segment 120, substrate 130, and intermediate supporting element 140, respectively, of the superabrasive compact 100 (FIGS. 1A-1B).

In an embodiment, the superabrasive cutting segment 120*d* may have a greater thickness than the intermediate supporting element 140*d*, but less than the mounting hub 110*d*. Generally, the intermediate supporting element 140*d* may include any suitable material. In an embodiment, the intermediate supporting element 140*d* may include a superabrasive material, such as tungsten carbide, polycrystalline diamond (e.g., leached, partially leached, or unleached), etc. Alternatively or additionally, at least a portion of the intermediate supporting element 140*d* may include a material that is generally softer and/or more easily deformable than the material of the superabrasive cutting segment 120*d*. For example, the superabrasive cutting segment 120*d* may include thermally-stable polycrystalline diamond, and the intermediate supporting element 140*d* may include a steel alloy, a brass alloy, a bronze alloy or another suitable metal alloy.

The substrate 130*d* and the mounting hub 110*d* may be bonded together, and/or the intermediate supporting element 140*d* and the substrate 130*d* may be bonded together. As described above, the mounting hub 110*d* and superabrasive cutting segment 120*d* may be brazed or otherwise bonded together, and/or the superabrasive cutting segment 120*d* and the intermediate supporting element 140*d* may be brazed or otherwise bonded together. In other embodiments, the superabrasive cutting segment 120*d* may be unbonded from the mounting hub 110*d* and/or from the intermediate supporting element 140*d* (e.g., as described above in connection with FIG. 4). Further, the intermediate supporting element 140*d* may be bonded to the substrate 130*d* or may be unbonded therefrom.

Figure 6:
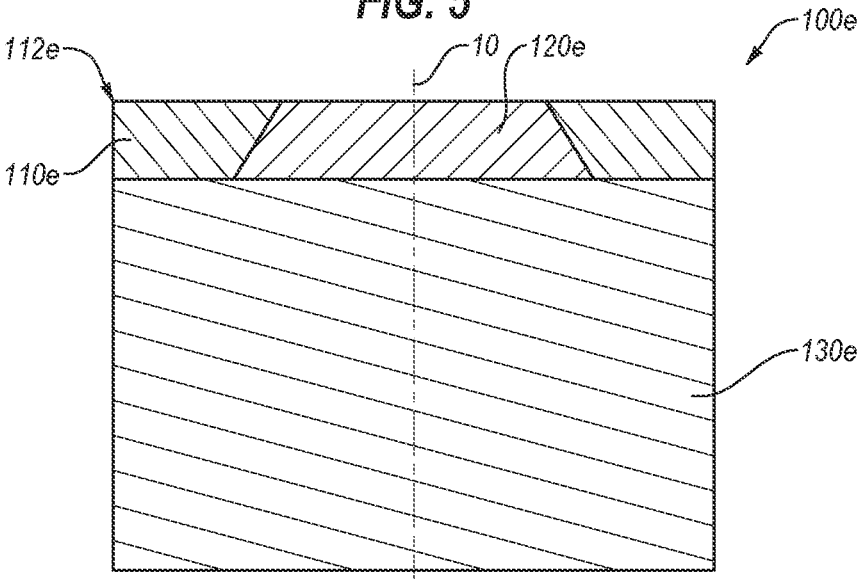
FIG. 6 is a cross-sectional view of a superabrasive compact, according to at least one additional or alternative embodiment.

As mentioned above, the mounting hub and/or the superabrasive cutting segment may have chamfers, radii (or fillet), etc., which may be the same size or may have different sizes. Alternatively, the mounting hub and/or the superabrasive cutting segment may have no chamfer. FIG. 6 illustrates a superabrasive compact 100*e* according to an embodiment. In some embodiments, the superabrasive compact 100*e* and its materials, features, elements, or components may be similar to or the same as the any of the superabrasive compacts 100, 100*a*, 100*b*, 100*c*, 100*d* (FIGS. 1A-5) and their corresponding materials, features, elements, and components. For example, the superabrasive compact 100*e* may include mounting hub 110*e*, superabrasive cutting segment 120*e*, and substrate 130*e*, which may be similar to or the same as the mounting hub 110*a*, superabrasive cutting segment 120*a*, and substrate 130*a* of the superabrasive compact 100*a* (FIG. 2).

In an embodiment, the mounting hub 110*e* may have a substantially sharp corner or edge 112*e* that may be formed between the peripheral surface and the upper surface of the mounting hub 110*e*. Under some operating conditions, at least a portion of the sharp edge 112*e* may engage and fail material during operation. Furthermore, the superabrasive cutting segment 120*e* may have a sharp corner or edge, which may be defined between an upper surface and a portion peripheral surface of the superabrasive cutting segment. At least a portion of such edge may engage and fail material during operation.

Figure 7:
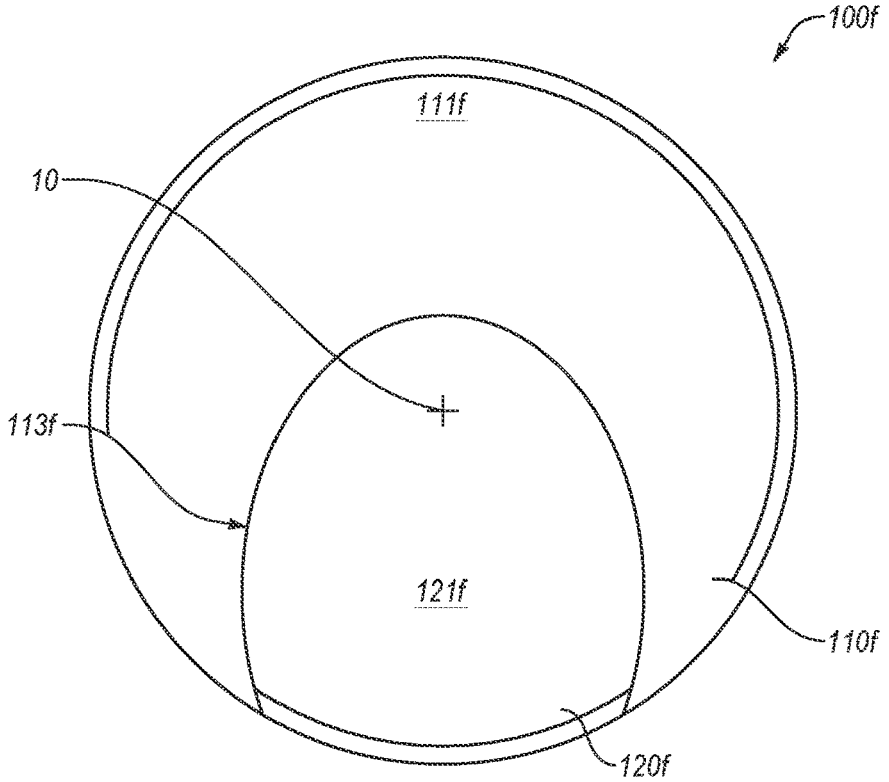
FIG. 7 is a top plan view of a superabrasive compact, according to an embodiment.

As described above, the mounting hub and the superabrasive cutting segment may have any number of suitable complementary shapes, which may vary from one embodiment to another. FIG. 7 illustrates a superabrasive compact 100*f* according to an embodiment. In some embodiments, the superabrasive compact 100*f* and its materials, features, elements, or components may be similar to or the same as the any of the superabrasive compacts 100, 100*a*, 100*b*, 100*c*, 100*d*, 100*e* (FIGS. 1A-6) and their corresponding materials, features, elements, and components. For example, the superabrasive compact 100*f* may include mounting hub 110*f* and superabrasive cutting segment 120*f* that may be similar to or the same as the mounting hub 110 and superabrasive cutting segment 120 of the superabrasive compact 100 (FIGS. 1A-1B).

In an embodiment, the mounting hub 110*f* may include a mounting feature 113*f* that may secure the superabrasive cutting segment 120*f* (e.g., the mounting feature 113*f* may be an opening that has a substantially elliptical or partially elliptical cross-sectional shape, and the superabrasive cutting segment 120*f* may have a corresponding cross-sectional shape). For example, a surface or edge of the superabrasive cutting segment 120*f* may extend beyond the mounting feature 113*f*. At least a portion of such surface or edge may engage and/or fail material during operation. Furthermore, the exposed edge of the superabrasive cutting segment 120*f* may be substantially continuous with and/or may lie along the peripheral surface (e.g., a substantially cylindrical surface) or edge(s) of the mounting hub 110*f*. For example, the cutting edge of the superabrasive cutting segment 120*f* may be formed by an upper surface 121*f* and peripheral surface of the superabrasive cutting segment 120*f*, and the edge of the mounting hub 110*f* may be formed by an upper surface 111*f* and peripheral surface of the superabrasive compact 100*f*). In at least one embodiment, the partial shape of the mounting feature 113*f* may have a side opening within which a portion of the superabrasive cutting segment 120*f* is positioned.

As described above, at least a portion of the mounting feature 113*f* may be defined by tapered or angled walls, and corresponding one or more portions of the mounting hub 110*f* may have a substantially complementary taper(s). More specifically, for example, the substantially complementary shapes of the mounting feature 113*f* and the peripheral surface of the superabrasive cutting segment 120*f* may be such that the mounting feature 113*f* prevents or limits axial movement of the superabrasive cutting segment 120*f* relative to the mounting hub 110*f* (e.g., along longitudinal axis 10). Moreover, the elliptical or partially elliptical cross-sectional shape of the mounting feature 113*f* may prevent or limit movement of the mounting hub 110*f* along one or more directions perpendicular to the longitudinal axis 10 (e.g., along one or more directions in a plane that is substantially coplanar with the upper surface 111*f* and/or upper surface 121*f*).

As described above, in some embodiments, the mounting feature 113*f* may have a downward-facing taper. It should be appreciated that the terms "mounting hub" and "superabrasive cutting segment" are used for descriptive purposes only and should not be interpreted to require or connote a specific shape or structure therefor. For example, a superabrasive compact may have a mounting hub that has an upper surface shape that is similar to or the same as cross-sectional shape of the superabrasive cutting segment 120*f* and a superabrasive cutting segment that has an upper surface shape that is similar to or the same as the mounting hub 110*f*.

Figure 8A:
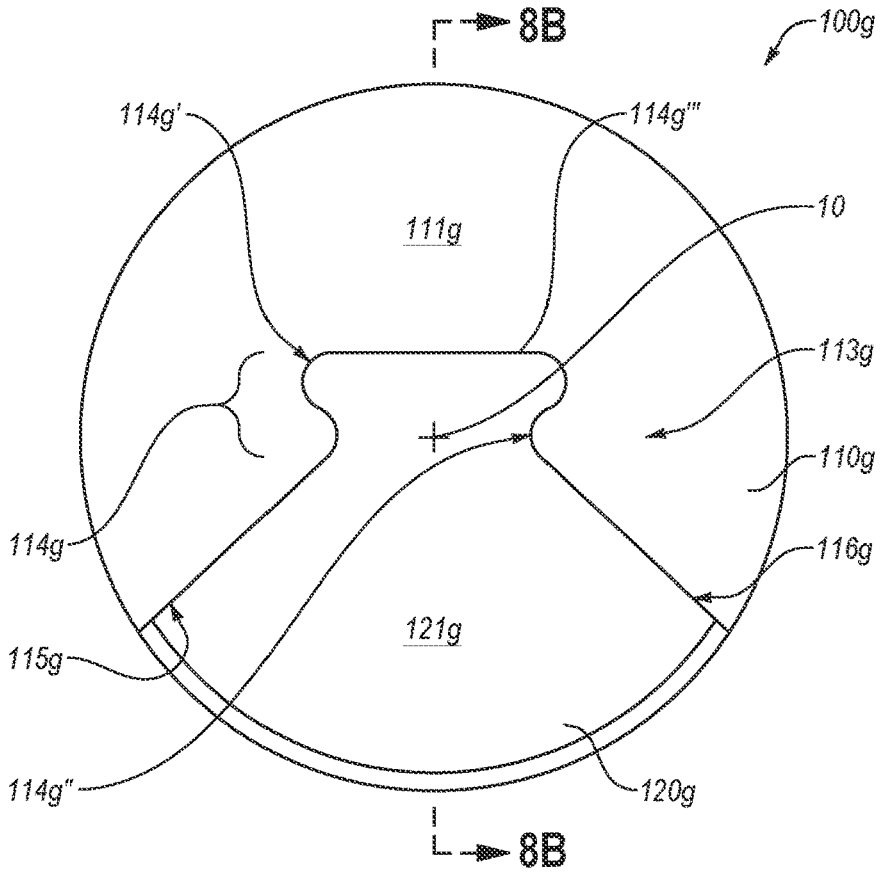
FIG. 8A is a top plan view of a superabrasive compact, according to another embodiment.

In an embodiment, a portion of the cross-sectional shape of the mounting feature of the mounting hub and of the superabrasive cutting segment may include a key, slot, or dove-tail feature. FIG. 8A illustrates a superabrasive compact 100*g* according to an embodiment. In some embodiments, the superabrasive compact 100*g* and its materials, features, elements, or components may be similar to or the same as the any of the superabrasive compacts 100, 100*a*, 100*b*, 100*c*, 100*d*, 100*e*, 100*f* (FIGS. 1A-7) and their corresponding materials, features, elements, and components. For example, the superabrasive compact 100*g* may include mounting hub 110*g* and superabrasive cutting segment 120*g* that may be similar to or the same as the mounting hub 110 and superabrasive cutting segment 120 of the superabrasive compact 100 (FIGS. 1A-1B).

In an embodiment, the mounting hub 110*g* has a mounting feature 113*g* that at least partially secures the superabrasive cutting segment 120*g* relative to the mounting hub 110*f*. For example, the cross-sectional shape of the mounting feature 113*g* includes a dove-tail feature 114*g* and substantially straight portions 115*g*, 116*g* extending from the key portion 114*g*. The straight portions 115*g*, 116*g* may form or define any suitable angle therebetween.

In an embodiment, the key portion 114*g* may include or may be partially defined by opposing inner radii 114*g*', outer radii 114*g*" transitioning from the inner radii 114*g*', and a connecting segment 114*g*'" (e.g., a straight segment) connecting the opposing inner radii 114*g*'. In such an embodiment, the key portion 114*g* may limit or prevent movement of the superabrasive cutting segment 120*g* relative to the mounting hub 110*g* (e.g., along one or more directions in a plane that is substantially coplanar with or substantially parallel to upper surface 111*g* of the mounting hub 110*g* and/or upper surface 121*g* of the superabrasive cutting segment 120*g*).

As mentioned above, the straight portions 115*g*, 116*g* may define any suitable angle therebetween (e.g., 30 degrees, 45 degrees, 90 degrees, etc.). Moreover, the straight portions 115*g*, 116*g* may extend to the periphery of the mounting hub 110*g*, such as to form an opening or gap in the peripheral surface of the mounting hub 110*g*. More specifically, for example, a portion of the peripheral surface of the superabrasive cutting segment 120*g* may extend in the gap (e.g., to close the gap) in the periphery of the mounting hub 110*g* at locations where the straight portions 115*g*, 116*g* intersect the periphery and/or end at the periphery of the mounting hub 110*g*. In an embodiment, cutting edge of the superabrasive cutting segment 120*g* may be formed or defined substantially at the periphery of the superabrasive cutting segment 120*g* and between the straight portions 115*g*, 116*g*.

Figure 8B:
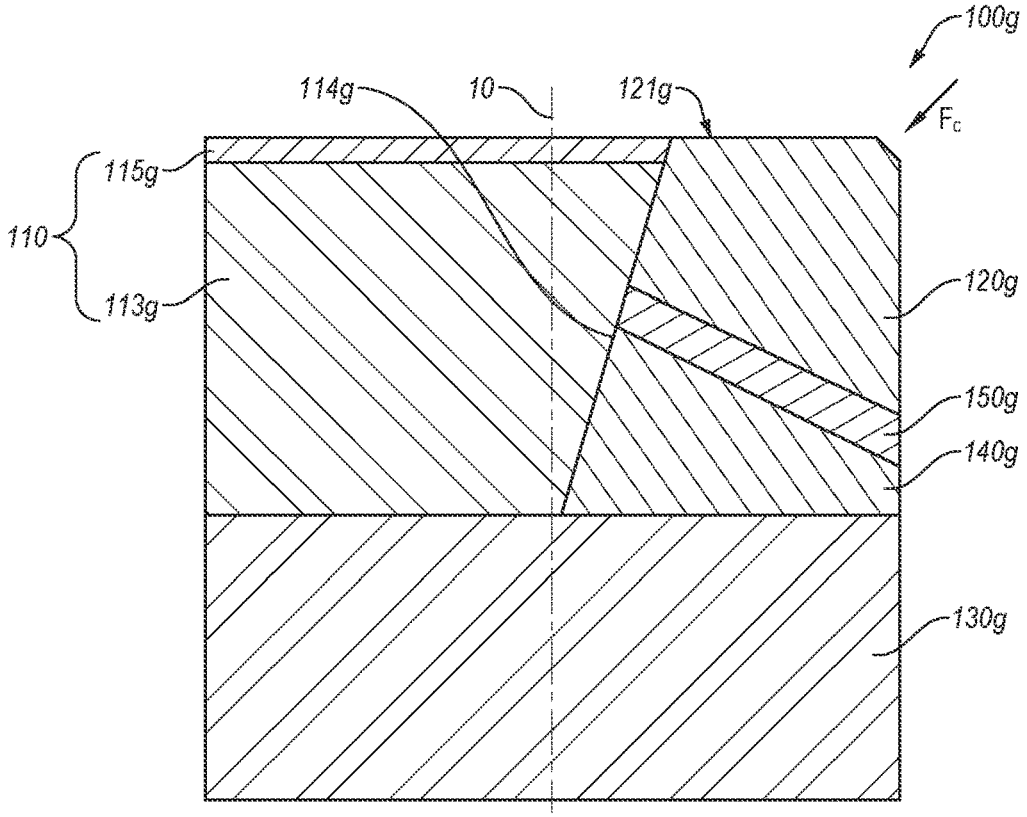
FIG. 8B is a cross-sectional view of the superabrasive compact of FIG. 8A.

In some embodiments, the superabrasive cutting segment 120*g* may be supported by multiple elements and/or components of the superabrasive compact 100*g*. As shown in FIG. 8B, for example, the superabrasive cutting segment 120*g* may be supported by a first intermediate supporting element 140*g* and a second intermediate supporting element 150*g*. For example, the first and second intermediate supporting elements may be positioned between the superabrasive cutting segment 120*g* and the substrate 130*g*.

Generally, the first and second intermediate supporting elements 140*g*, 150*g* may comprise any suitable material(s). In an embodiment, the first intermediate supporting element 140*g* includes cemented tungsten carbide, and the second intermediate supporting element 150*g* includes polycrystalline diamond. For example, the first and second intermediate supporting elements 140*g*, 150*g* may be unbonded to one another or may be bonded together. Moreover, the second intermediate supporting element 150*g* and the superabrasive cutting segment 120*g* may be unbonded to one another or may be bonded together.

In some embodiments, the second intermediate supporting element 150*g* may be positioned and/or oriented at a selected angle relative to the superabrasive cutting segment 120*g*. For example, an interface between the superabrasive cutting segment 120*g* and the second intermediate supporting element 150*g* may be non-parallel to the upper surface 121*g* of the superabrasive cutting segment 120*g*. In some embodiments, the upper surface of the second intermediate supporting element 150*g* and/or the interface between the superabrasive cutting segment 120*g* and the second intermediate supporting element 150*g* may be oriented substantially perpendicular to an intended or an anticipated cutting force $F_c$ that may be applied to the superabrasive cutting segment 120*g* during operation of the superabrasive compact 100*g*.

In some embodiments, the mounting hub 110*g* may include one or more elements and/or layers. In the illustrated embodiment, the mounting hub 110*g* includes a lower portion 113*g* and an upper portion 115*g*. For example, the lower portion 113*g* may include tungsten carbide and the upper portion 115*g* may include polycrystalline diamond (e.g., a layer or table of polycrystalline diamond). Additionally or alternatively, the upper portion 115*g* may include and/or may be defined by a coating that may be applied to, formed on, and/or bonded to the lower portion 113*g*.

As described above, one or more portions of the mounting feature(s) may be tapered in a manner that prevents or limits axial movement of the superabrasive cutting segment(s) relative to the mounting hub. Additionally or alternatively, one or more portions of the mounting feature(s) may be substantially parallel relative to the longitudinal axis of the superabrasive compact. Moreover, any one or more portions of any sidewall that at least partially defines the mounting feature and/or a complementary shape of the superabrasive cutting segment may be substantially straight or may extend substantially parallel to the longitudinal axis of the superabrasive compact.

Figure 8C:
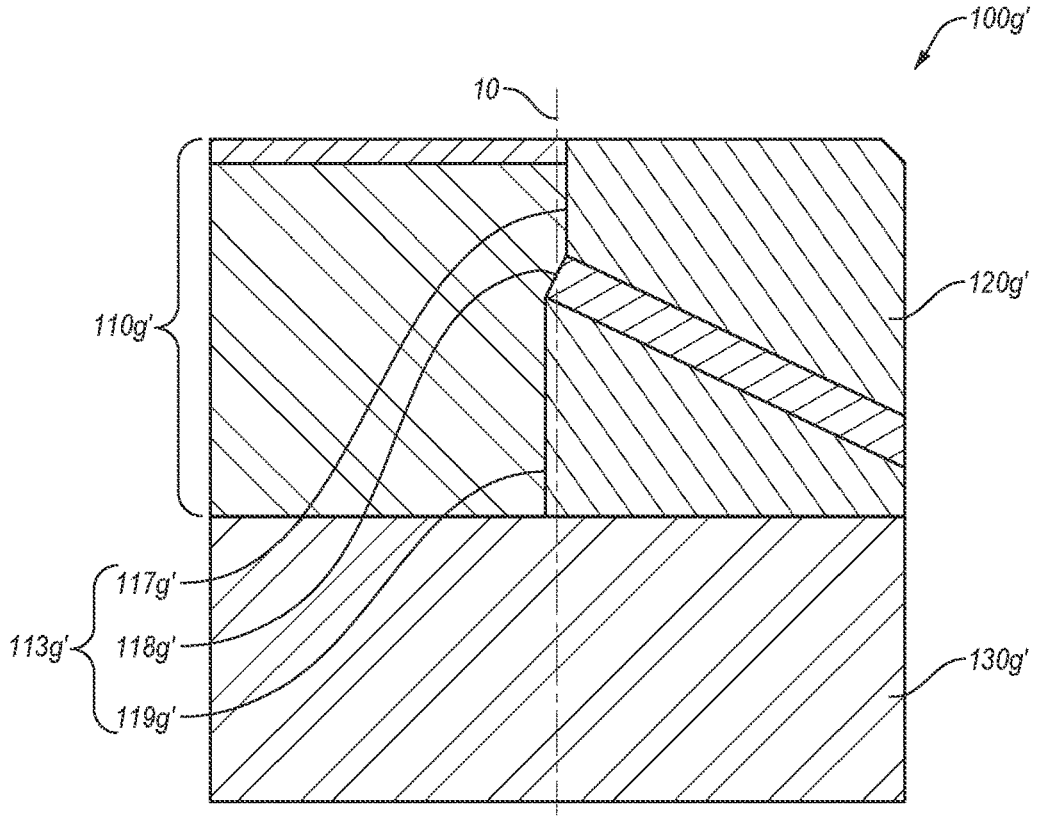
FIG. 8C is a cross-sectional view of a superabrasive compact, according to an embodiment.

FIG. 8C illustrates a superabrasive compact 100*g*' that includes a mounting feature 113*g*' that has one or more straight or non-tapered sidewall portions. In some embodiments, the superabrasive compact 100*h* and its materials, features, elements, or components may be similar to or the same as the any of the superabrasive compacts 100, 100*a*, 100*b*, 100*c*, 100*d*, 100*e*, 100*f*, 100*g*, 100*g*' (FIGS. 1A-8B) and their corresponding materials, features, elements, and components. For example, the superabrasive compact 100*g*' may include a mounting hub 110*g*', a superabrasive cutting segment 120*g*', a substrate 130*g*', and first and second intermediate supporting elements 140*g*', 150*g*' positioned between the substrate 130*g*' and the superabrasive cutting segment 120*g*', which may be similar to the mounting hub 110*g*, superabrasive cutting segment 120*g*, substrate 130*g*, and first and second intermediate supporting elements 140*g*, 150*g* of the superabrasive compact 100*g* (FIG. 8B).

In the illustrated example, the mounting hub 110*g*' has a mounting feature 113*g*' that includes a first straight portion 117*g*', a second straight portion 119*g*', and a tapered portion 118*g*' extending therebetween. For example, one or more portions of one, some, or each of the side walls that define the mounting feature 113*g*' may be straight, and/or one or more portions of one, some, or each of the side walls that define the mounting feature 113*g*' may be tapered (e.g., may have a downward-facing taper, as shown in FIG. 8C). In some embodiments, the tapered portion 118*g*' may extend approximately the thickness of the second intermediate supporting element 150*g*'. Furthermore, in at least one embodiment, the sidewall defining the tapered portion 118*g*' may be substantially perpendicular to the interface between the second intermediate supporting element 150*g*' and the superabrasive cutting segment 120*g*' (e.g., the sidewall may be oriented substantially parallel to a force that is intended to be applied to the superabrasive compact 100*g*' during operation).

Figure 9:
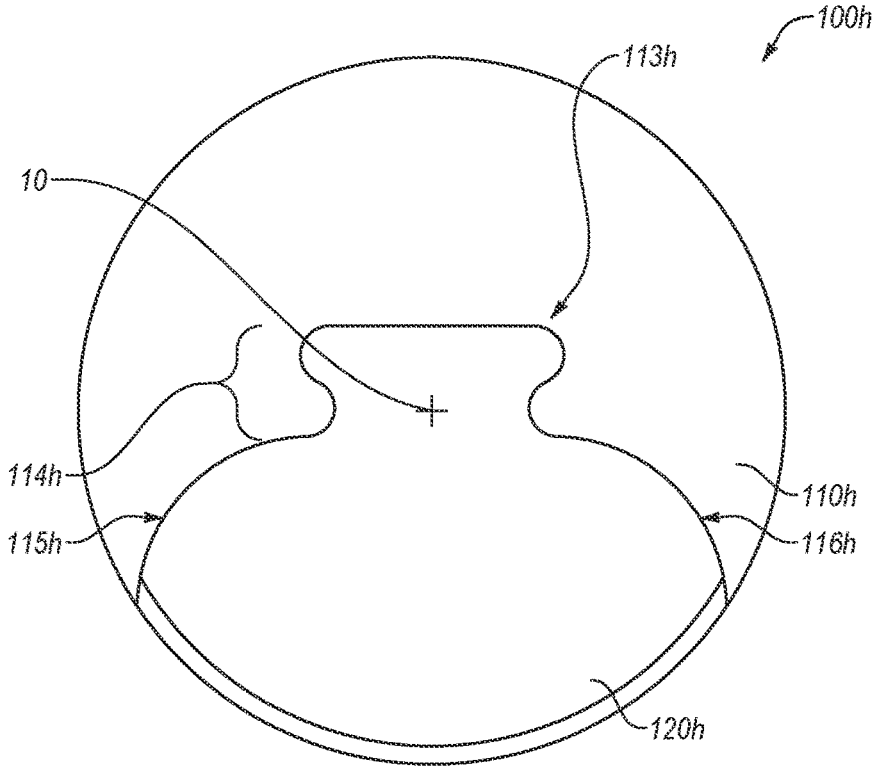
FIG. 9 is a top plan view of a superabrasive compact, according to yet one other embodiment.

It should be appreciated that the portions of the mounting feature, which extend from the key portion thereof and define at least a portion of the space for the cutting edge of the superabrasive cutting segment, may have any suitable shape. For example, such portions may have generally arcuate shapes. FIG. 9 illustrates a superabrasive compact 100*h* according to an embodiment. In some embodiments, the superabrasive compact 100*h* and its materials, features, elements, or components may be similar to or the same as the any of the superabrasive compacts 100, 100*a*, 100*b*, 100*c*, 100*d*, 100*e*, 100*f*, 100*g*, 100*g*', 100*g*' (FIGS. 1A-8C) and their corresponding materials, features, elements, and components. For example, the superabrasive compact 100*h* may include mounting hub 110*h* and superabrasive cutting segment 120*h* that may be similar to or the same as the mounting hub 110*g* and superabrasive cutting segment 120*g*, respectively, of the superabrasive compact 100*g* (FIG. 8A).

In an embodiment, the mounting hub 110*h* may include a mounting feature 113*h* that has a key portion 114*h* that may be similar to or the same as the key portion 114*g* of the mounting hub 110*g* (FIG. 8A). In the illustrated embodiment, the mounting feature 113*h* may include arcuate segments 115*h*, 116*h* extending from the key portion 114*h* to the periphery of the mounting hub 110*h*. For example, the arcuate segments 115*h*, 116*h* may define concave shapes or spaces of the mounting hub 110*h* into which corresponding portions of the superabrasive cutting segment 120*h* may be positioned.

Figure 10:
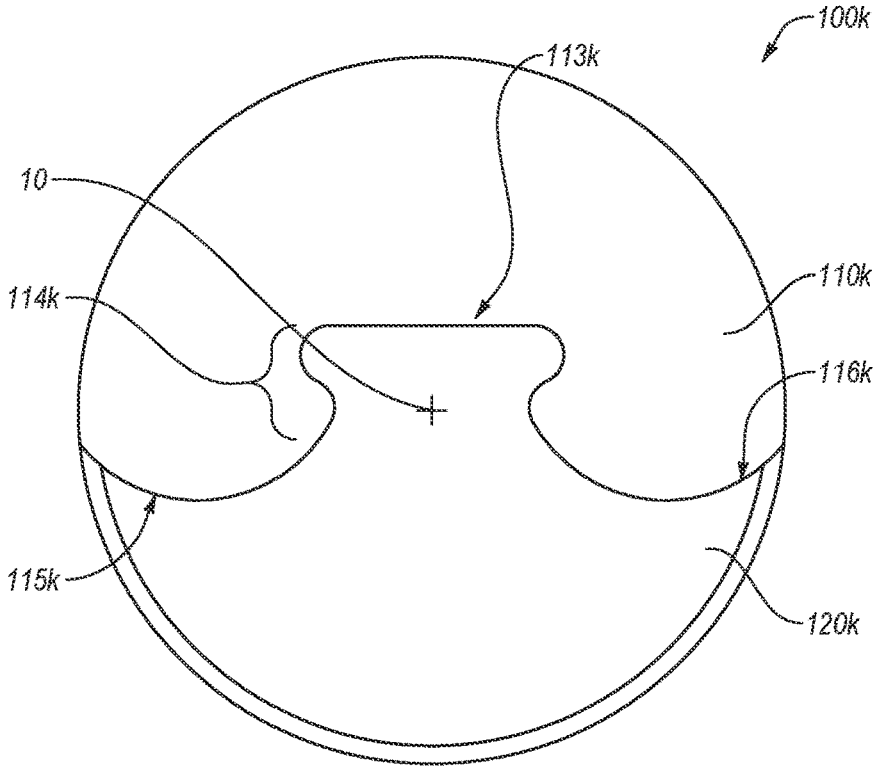
FIG. 10 is a top plan view of a superabrasive compact, according to one or more embodiments.

Alternatively, such segments may form or define convex portions of the mounting feature of the mounting hub. FIG. 10 illustrates a superabrasive compact 100*k* according to an embodiment. In some embodiments, the superabrasive compact 100*k* and its materials, features, elements, or components may be similar to or the same as the any of the superabrasive compacts 100, 100*a*, 100*b*, 100*c*, 100*d*, 100*e*, 100*f*, 100*g*, 100*g*', 100*h* (FIGS. 1A-9) and their corresponding materials, features, elements, and components. For example, the superabrasive compact 100*k* may include mounting hub 110*k* and superabrasive cutting segment 120*k* that may be similar to or the same as the mounting hub 110*g* and superabrasive cutting segment 120*g*, respectively, of the superabrasive compact 100*g* (FIG. 8A).

The mounting hub 110*k* may include a mounting feature 113*k* that has a key portion 114*k* that may be similar to or the same as the key portion 114*g* of the mounting hub 110*g* (FIG. 8A). In the illustrated embodiment, the mounting feature 113*k* includes arcuate portions 115*k*, 116*k* extending from the key portion 114*k* to the periphery of the mounting hub 110*k*. More specifically, for example, the arcuate portions 115*k*, 116*k* may form or define convex portions of the mounting feature hub 110*k* that may abut corresponding portions of the superabrasive cutting segment 120*k*.

Figure 11A:
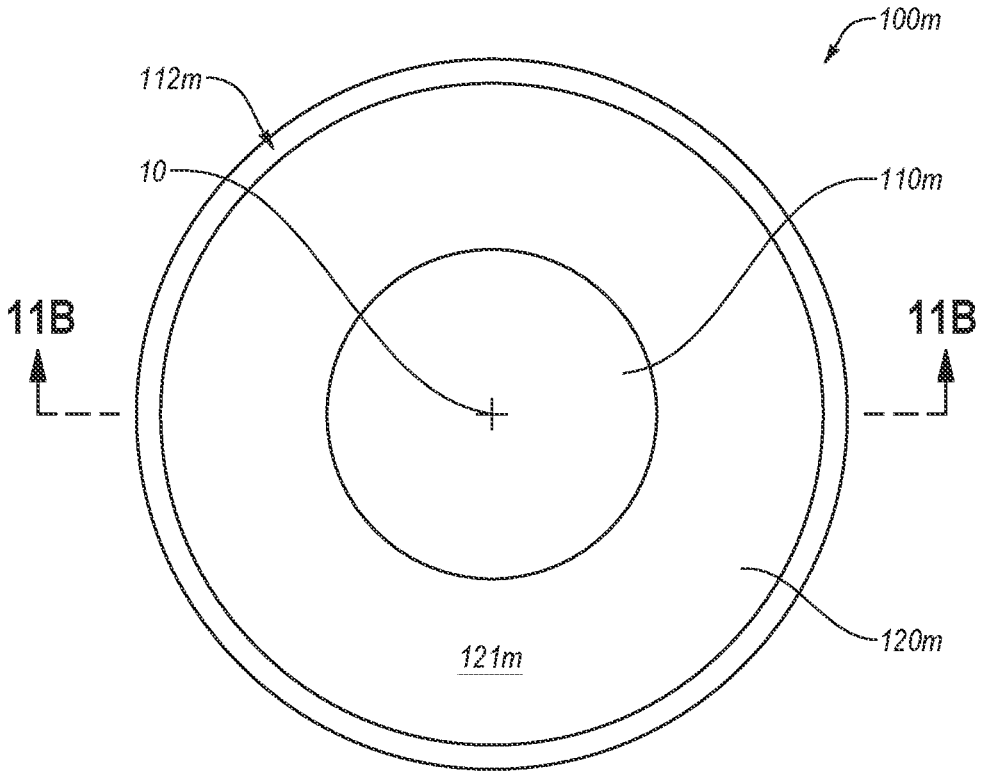
FIG. 11A is a top plan view of a superabrasive compact, according to an embodiment.
Figure 11B:
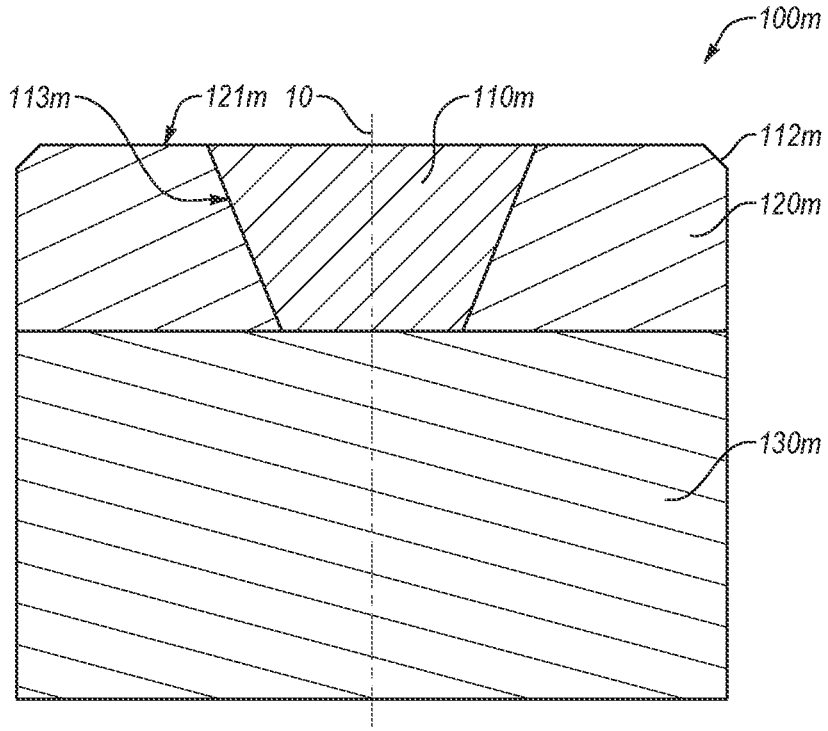
FIG. 11B is a cross-sectional view of the superabrasive compact of FIG. 11A.

As described above, the superabrasive cutting segment(s) may include or may form a cutting edge of the superabrasive compact. Moreover, the cutting edge of the superabrasive compact may have any suitable length (e.g., may extend about circumference of the periphery of the superabrasive compact to any suitable length). For example, the cutting edge may extend about majority or the entire periphery or perimeter of the superabrasive compact. FIGS. 11A-11B illustrate a superabrasive compact 100*m* according to an embodiment. In particular, FIG. 11A is a top plan view of the superabrasive compact 100*m*, and FIG. 11B is a cross-sectional view of the superabrasive compact 100*m*, as shown in FIG. 11A. In some embodiments, the superabrasive compact 100*m* and its materials, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k* (FIGS. 1A-10) and their corresponding materials, features, elements, and components. For example, the superabrasive compact 100*m* may include mounting hub 110*m*, superabrasive cutting segment 120*m* including chamfer 112*m*, and substrate 130*m*, which may be similar to or the same as the mounting hub 110, superabrasive cutting segment 120, and substrate 130, respectively, of the superabrasive compact 100 (FIGS. 1A-1B).

In the illustrated embodiment, the superabrasive cutting segment 120*m* has a generally annular or toroidal shape, and the mounting hub 110*m* has a substantially frusto-conical shape. Moreover, the mounting hub 110*m* may include a mounting feature 113*m* that has a downward-facing taper, such as to secure the superabrasive cutting segment 120*m* to the substrate 130*m* (e.g., the mounting hub 110*m* and/or the superabrasive cutting segment 120*m* may be bonded, for example, brazed, to the substrate 130*m*). As shown in FIG. 11A, the superabrasive cutting segment 120*m* may include an upper surface 121*m* that extends about the periphery of the superabrasive cutting segment 120*m*. In an embodiment, the upper surface 121*m* may be substantially continuous (e.g., uninterrupted). For example, the superabrasive cutting segment 120*m* may be solid, monolithic, or unitary.

As described above, the mounting hub 110*m* (e.g., at mounting feature 113*m*) may secure the superabrasive cutting segment 120*m* to the substrate 130*m*. For example, the mounting hub 110*m* may be bonded to the superabrasive cutting segment 120*m*. Additionally or alternatively, the superabrasive cutting segment 120*m* may be bonded to the substrate 130*m*. Optionally, in at least one embodiment, the superabrasive compact 100*m* may include an intermediate supporting element positioned between the superabrasive cutting segment 120*m* and the substrate 130*m* (e.g., the superabrasive cutting segment 120*m* may be bonded to the intermediate supporting element that may be bonded to the substrate 130*b*. In some embodiments, as mentioned above, the superabrasive cutting segment 120*m* may be unbonded from the mounting hub 110*m* and/or substrate 130*m*. In some embodiments, the superabrasive cutting segment 120*m* may be rotatable about mounting hub 110*m*.

Figure 11C:
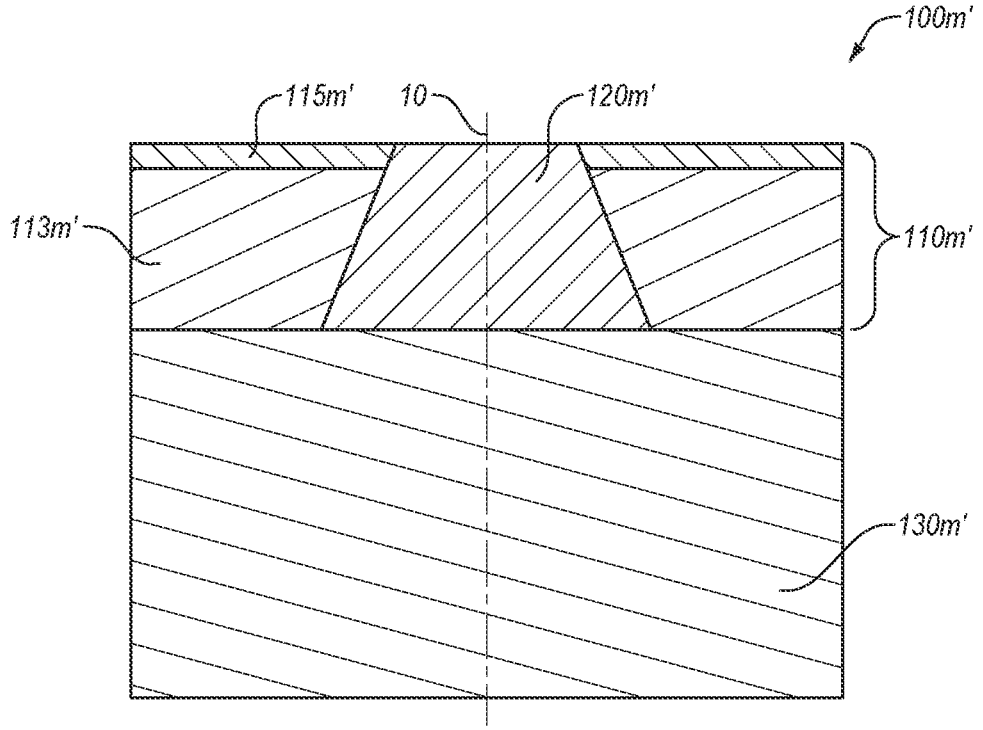
FIG. 11C is a cross-sectional view of a superabrasive compact, according to an embodiment.

As noted above, a superabrasive compact may have a mounting hub that has a shape (e.g., a cross-sectional shape) that is similar to or the same as cross-sectional shape of any superabrasive cutting segment described herein, and the superabrasive cutting segment that has a shape (e.g., cross-sectional shape) that is similar to or the same as any mounting hub described herein. As shown in FIG. 11C, a superabrasive compact 100*m*' may include a superabrasive cutting segment 120*m*' surrounded by mounting hub 110*m*' and secured to substrate 130*m*' thereby. In some embodiments, the superabrasive compact 100*m*' and its material, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m* (FIGS. 1A-11B).

For example, a perimeter of the superabrasive cutting segment 120*m*' may be partially laterally surrounded by the mounting hub 110*m*'. In an embodiment, the top surface shape of the superabrasive cutting segment 120*m*' may be substantially the same as the shape of a top opening of the mounting hub 110*m* (FIG. 11A), and the shape of a top opening of the mounting hub 110*m*' may be substantially the same as the cross-sectional shape of the superabrasive cutting segment 120*m*' (FIG. 11C). It should be appreciated, however, that as shown in FIG. 11C, the superabrasive cutting segment 120*m*' has a downward-facing taper (e.g., similar to the superabrasive cutting segment 120 (FIGS. 1A-1B)).

Figure 11D:
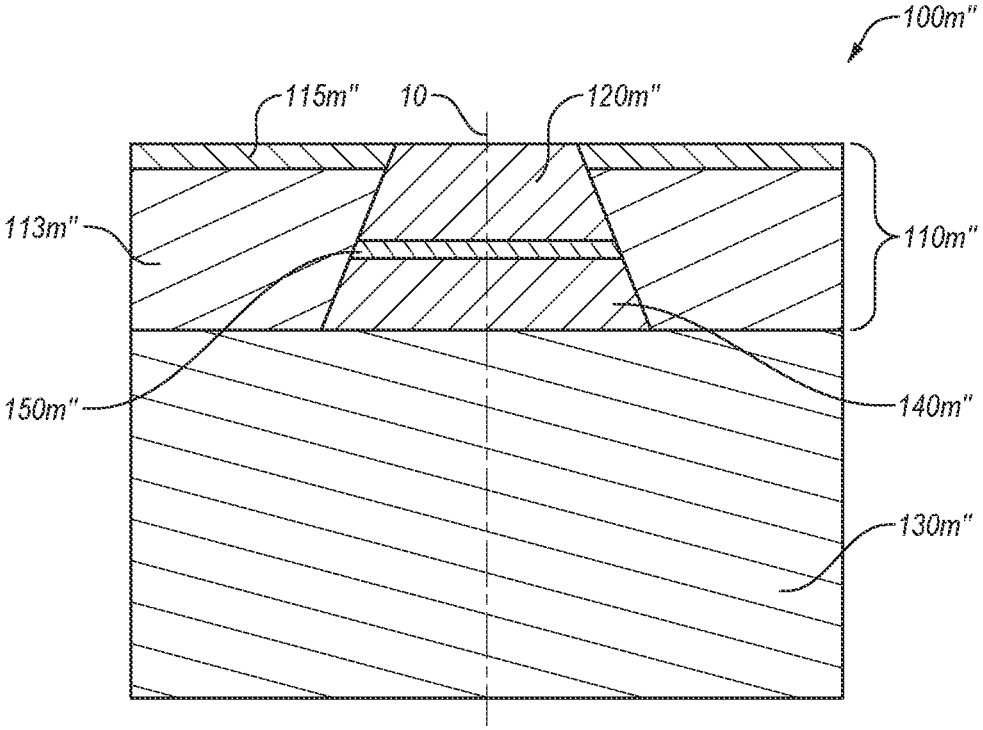
FIG. 11D is a cross-sectional view of a superabrasive compact, according to another embodiment.

In an embodiment, the mounting hub 110*m*' may include a lower portion 113*m*' and an upper portion 115*m*'. For example, the lower portion 113*m*' may include cemented tungsten carbide (e.g., cobalt-cemented tungsten carbide), and an upper portion may include polycrystalline diamond (e.g., the upper portion 115*m*' may be a thin layer of polycrystalline diamond). In the illustrated embodiment, the superabrasive cutting segment 120*m*' is secured to the substrate 130*m*' without intervening elements therebetween. Alternatively, as shown in FIG. 11D, a superabrasive compact 100*m*" may include an intermediate supporting element 140*m*" and deformable material 150*m*" positioned between superabrasive cutting segment 120*m*" and substrate 130*m*". In some embodiments, the superabrasive compact 100*m*" and its material, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m*, 100*m*' (FIGS. 1A-11C).

As shown in FIG. 11D, the superabrasive compact 100*m*" includes superabrasive cutting segment 120*m*'", mounting hub 110*m*'", and substrate 130*m*'" that may be the same or similar to the mounting hub 110*m*', superabrasive cutting segment 120*m*', and substrate 130*m*', respectively, of the superabrasive compact 100*m*' (FIG. 11C). In some embodiments, the mounting hub 110*m*" includes lower portion 113*m*" and 115*m*", similar 113*m*' and 115*m*' of the mounting hub 110*m*' (FIG. 11C). As mentioned above, in the illustrated embodiment, the superabrasive compact 100*m*" includes the intermediate supporting element 140*m*" and deformable material 150*m*" positioned between the superabrasive cutting segment 120*m*" and the substrate 130*m*" (e.g., similar to the intermediate supporting element 140*c* and deformable material 150*c* shown in (FIG. 4).

Figure 12:
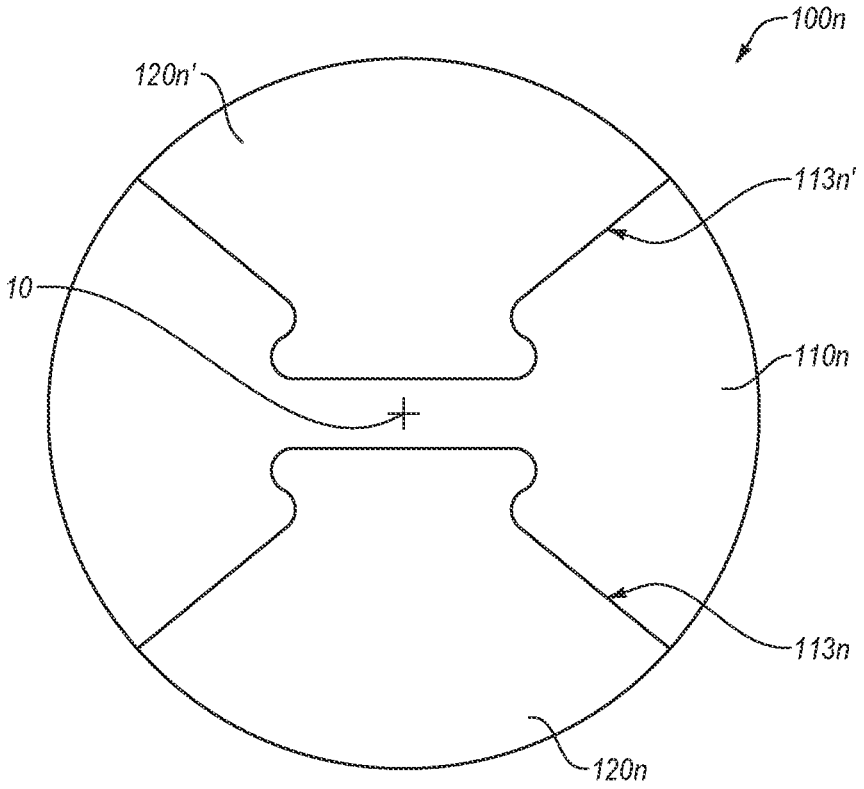
FIG. 12 is a top plan view of a superabrasive compact, according to an embodiment.

In some embodiments, the superabrasive compact may include multiple superabrasive cutting segments. FIG. 12 illustrates a superabrasive compact 100*n* according to an embodiment. In some embodiments, the superabrasive compact 100*n* and its materials, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m*, 100*m*', 100*m*" (FIGS. 1A-11D) and their corresponding materials, features, elements, and components. For example, the superabrasive compact 100*n* may include mounting hub 110*n*, superabrasive cutting segment 120*n*, which may be similar to or the same as the mounting hub 110*g* and superabrasive cutting segment 120*g*, respectively, of the superabrasive compact 100*g* (FIG. 8A).

In the illustrated embodiment, the superabrasive cutting segment 120*n* and superabrasive cutting segment 120*n*' may be similar to or the same as superabrasive cutting segment 120*g* (FIG. 8A). For example, the superabrasive compact 100*n* includes opposing superabrasive cutting segment 120*n* and superabrasive cutting segment 120*n*'. In an embodiment, the superabrasive cutting segment 120*n* and superabrasive cutting segment 120*n*' may be mirrored about a centerline of the superabrasive compact 100*m* (e.g., the superabrasive cutting segment 120*n* may be oriented at 180 degrees relative to the superabrasive cutting segment 120*n*'). Moreover, the mounting hub 110*n* may include mounting feature 113*n* and mounting feature 113*n*' that may correspond to and at least partially secure the respective superabrasive cutting segment 120*n* and superabrasive cutting segment 120*n*' (e.g., in the manner described above).

Figure 13:
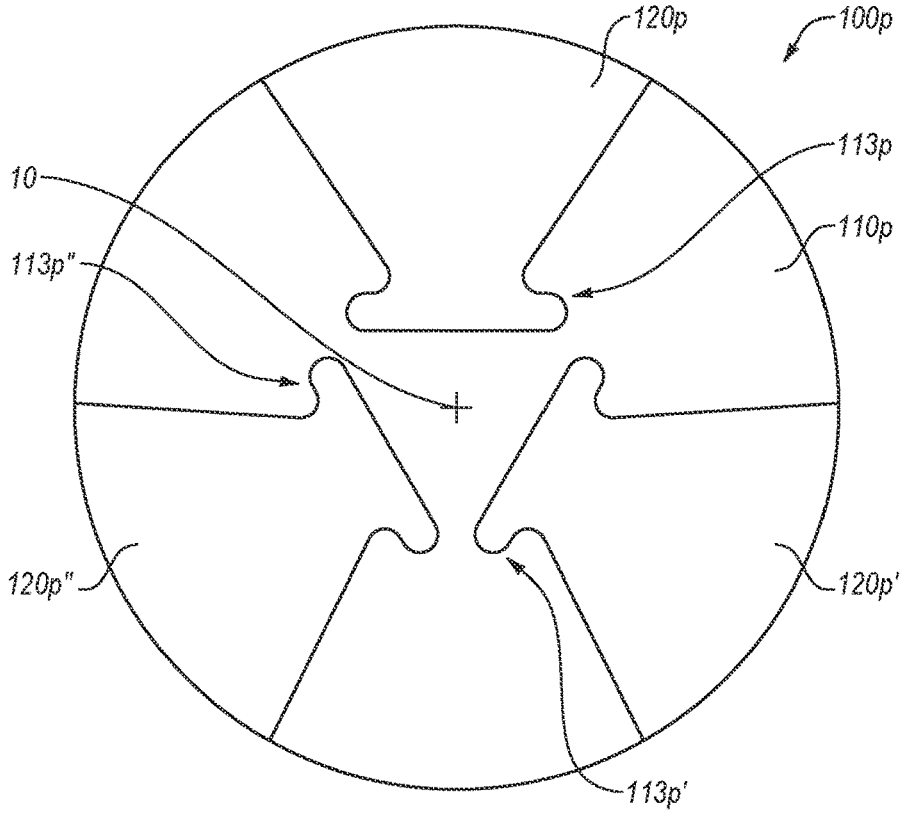
FIG. 13 is a top plan view of a superabrasive compact, according to another embodiment.

As noted above, the superabrasive compacts may include any number of superabrasive cutting segments. FIG. 13. illustrates a superabrasive compact 100*p* that includes three superabrasive cutting segments 120*p*, 120*p*', 120*p*'", according to an embodiment. In some embodiments, the superabrasive compact 100*p* and its materials, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m*, 100*m*', 100*m*", 100*n* (FIGS. 1A-12) and their corresponding materials, features, elements, and components.

For example, the superabrasive cutting segments 120*p*, 120*p*', and 120*p*'" may be similar to or the same as the superabrasive cutting segment 120*g* of the superabrasive compact 100*g* (FIG. 8A). More specifically, for example, the superabrasive cutting segments 120*p*, 120*p*', and 120*p*" may be shaped similar to the superabrasive cutting segment 120*g* (FIG. 8A), as described above, and may be sized such as to fit about and/or define at least a portion of the periphery of the superabrasive compact 100*p* (as illustrated in FIG. 13). In particular, the superabrasive cutting segments 120*p*, 120*p*', 120*p*" define corresponding edges and/or portions of the superabrasive compact 100*p*.

In the illustrated embodiment, the superabrasive cutting segments 120*p*, 120*p*', and 120*p*" are arranged at about 120 degree angles relative to each other (e.g., relative to centerlines or bisectors thereof dividing the respective superabrasive cutting segments 120*p*, 120*p*', and 120*p*"). It should be appreciated, however, that the superabrasive compact 100*p* may include any number of the superabrasive cutting segments that may be positioned at any suitable arrangement relative to one another (e.g., at any suitable angles). Moreover, while in the illustrated embodiment the superabrasive cutting segments 120*p*, 120*p*', and 120*p*" extend about and/or define only a portion of the periphery of the superabrasive compact 100*p*, in at least one embodiment, the superabrasive cutting segments may extend about and/or form the entire periphery or perimeter of the superabrasive compact.

Figure 14:
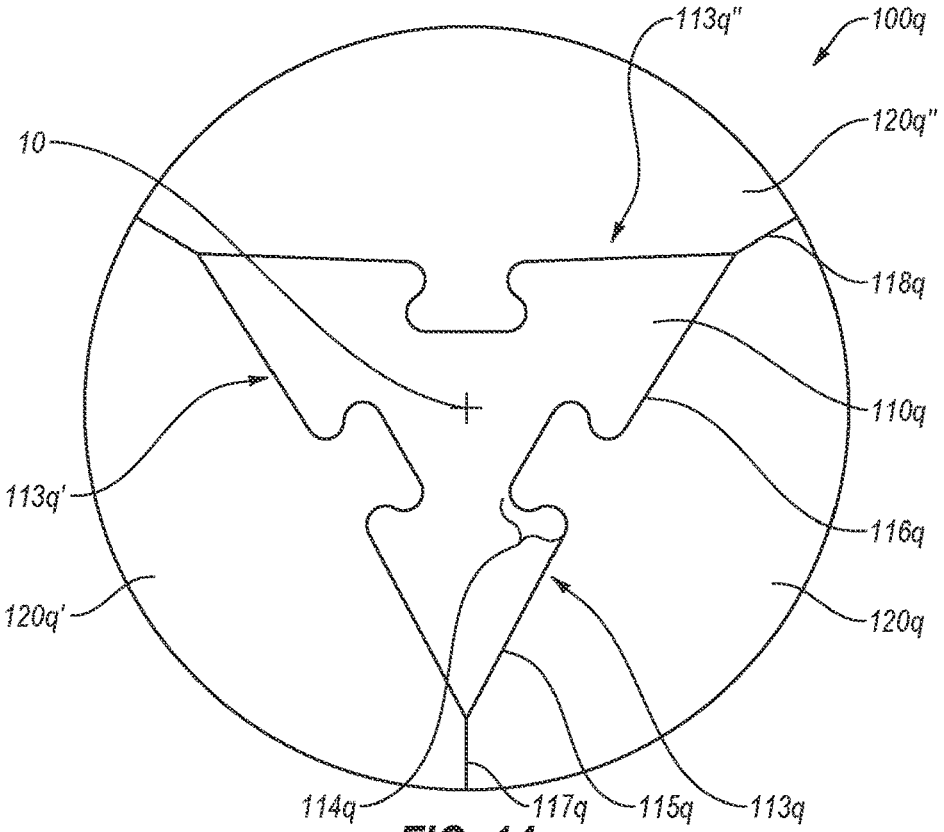
FIG. 14 is a top plan view of a superabrasive compact, according to yet another embodiment.

For example, as mentioned above, mounting features 113*p*, 113*p*', and 113*p*" may have portions extending from the key portion to the periphery of the mounting hub 110*p* and may define any suitable angle therebetween. Increasing the angle defined by the portions of the mounting features 113*p*, 113*p*', and 113*p*" increases the portion of the periphery or perimeter of the superabrasive compact 100*p* that is defined by one or more portions of the superabrasive cutting segments (e.g., the angles may be increased such that the superabrasive cutting segments form or define the entire periphery or perimeter that defines a boundary of the upper surface of the superabrasive compact). FIG. 14 illustrates a superabrasive compact 100*q* to include superabrasive cutting segments 120*q*, 120*q*', and 120*q*" that, according to an embodiment, collectively define or form the perimeter or periphery circumscribing the upper surface of the superabrasive compact 100*q*. In some embodiments, the superabrasive compact 100*q* and its materials, features, elements, or components may be similar to or the same as any of the superabrasive compacts 100, 100*a*, 100*b*, 100*c*, 100*d*, 100*e*, 100*f*, 100*g*, 100*g*', 100*h*, 100*k*, 100*m*, 100*m*', 100*m*", 100*n*, 100*p* (FIGS. 1A-13) and their corresponding materials, features, elements, and components.

For example, each of the superabrasive cutting segment 120*q*, superabrasive cutting segment 120*q*', and superabrasive cutting segment 120*q*" may define an approximately 120 degree angle (e.g., as defined between portion 117*q* and 118*q*). As mentioned above, the mounting hub 110*q* may have corresponding key portions and portions extending therefrom to the mounting hub 110*q*. In the illustrated embodiment, the mounting hub 110 includes mounting features 113*q*, 113*q*', and 113*q*" that secure corresponding ones of the superabrasive cutting segments 120*q*, 120*q*', and 120*q*". For example, the mounting feature 113*q* may include a key portion 114*q* and substantially straight portions 115*q*-118*q* extending therefrom and to the periphery or perimeter of the mounting hub 110*q*.

In the embodiment shown in FIG. 14, the portions 115*q* and 116*q* extend from the key portion 114*q* and define a first angle therebetween, and the portions 117*q* and 118*q* extend from the respective portions 115*q* and 116*q* to the periphery of the mounting hub 110*q* and define a second angle. The mounting feature 113*q* may be the same or similar to the mounting feature 113*q*' or mounting feature 113*q*". Again, it should be appreciated that the shape of any of the mounting features 113*q*, 113*q*', and 113*q*" may vary from one embodiment to the next (e.g., any of the portions may be arcuate, irregularly shaped, etc.).

Figure 15A:
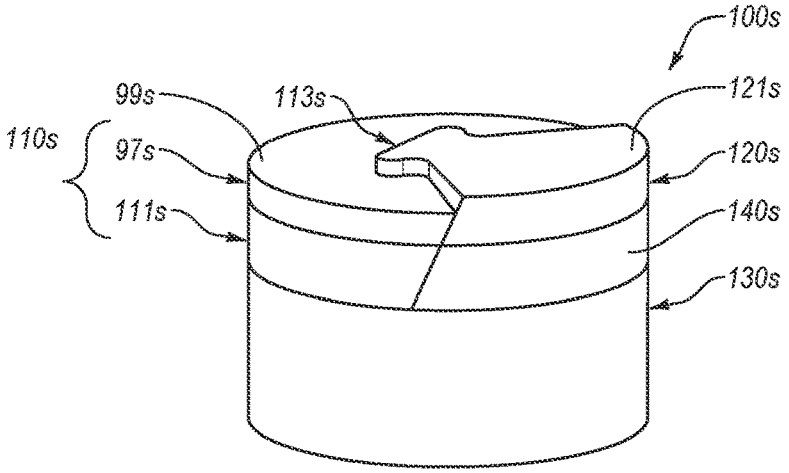
FIGS. 15A-15C are isometric views of various embodiments of superabrasive compacts.

In some embodiments, the top surfaces, side surfaces, and/or working surfaces of any of the superabrasive cutting segments disclosed herein may be contoured, nonplanar, planar, faceted, pointed, rounded, concave, convex, curved, combinations thereof, or otherwise selectively shaped. FIG. 15A illustrates a superabrasive compact 100*s* according to an embodiment. In some embodiments, the superabrasive compact 100*s* and its materials, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m*, 100*m*', 100*m*", 100*n*, 100*p*, or 100*q* and their corresponding materials, features, elements, and components. As shown in FIG. 15A, mounting hub 110*s* may comprise a superabrasive table 97*s* that is bonded to a substrate 111*s*. In other embodiments, the superabrasive compact 100*s* may include the mounting hub 110*s* and a superabrasive cutting segment 120*s*, which may be similar to or the same as the mounting hub 110*g* and superabrasive cutting segment 120*g*, respectively, of the superabrasive compact 100*g* (FIG. 8A). As shown in FIG. 15A, the superabrasive cutting segment 120*s* may be coupled with the mounting feature 113*s* of the mounting hub 110*s*. Further, FIG. 15A shows an embodiment of cutting segment 120*s* including an upper surface 121*s* which is offset from upper surface 99*s* of mounting hub 110*s* (e.g., the upper surface 121*s* of the cutting segment 120*s* may protrude outward past the upper surface 99*s* of the mounting hub 110*s*). Upper surface 121*s* may be contoured, nonplanar, planar, faceted, pointed, rounded, concave, convex, curved, combinations thereof, or otherwise selectively shaped. The superabrasive compact 100*s* may include an intermediate supporting element 140*s*, which may support, at least partially contact, or about a bottom surface of the superabrasive cutting segment 120*s*.

Figure 15B:
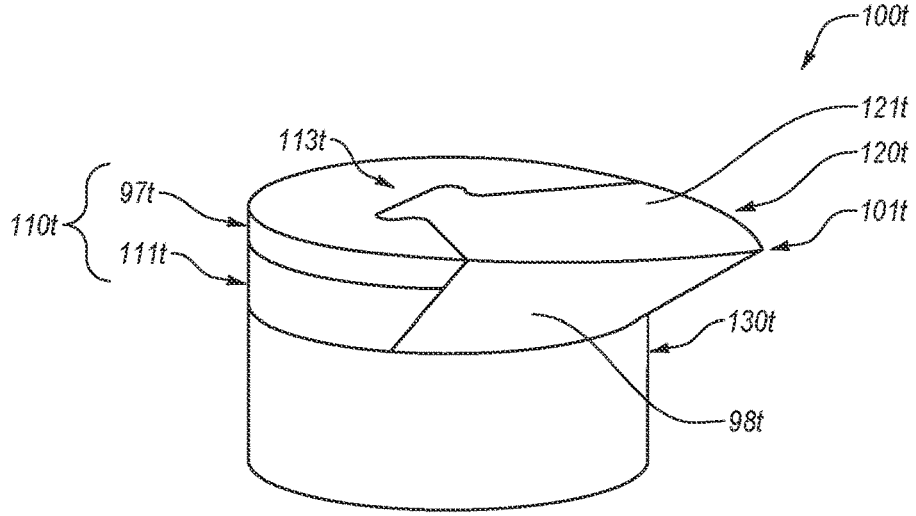

FIG. 15B illustrates a superabrasive compact 100*t* according to an embodiment. In some embodiments, the superabrasive compact 100*t* and its materials, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m*, 100*m*', 100*m*", 100*n*, 100*p*, or 100*q* and their corresponding materials, features, elements, and components. As shown in FIG. 15B, mounting hub 110*t* may comprise a superabrasive table 97*t* which is bonded to a substrate 111*t*. In other embodiments, the superabrasive compact 100*t* may include mounting hub 110*t* and a superabrasive cutting segment 120*t*, which may be similar to or the same as the mounting hub 110*g* and superabrasive cutting segment 120*g*, respectively, of the superabrasive compact 100*g* (FIG. 8A). As shown in FIG. 15B, the superabrasive cutting segment 120*t* may be coupled with the mounting feature 113*t* of the mounting hub 110*t*. Further, FIG. 15B shows an embodiment of cutting segment 120*t* including an upper surface 121*s* and peripheral surface 98*t*, which converge to form pointed region 101*t*. Upper surface 121*t* and/or peripheral surface 98*t* may be contoured, nonplanar, planar, faceted, pointed, rounded, concave, convex, curved, combinations thereof, or otherwise selectively shaped.

Figure 15C:
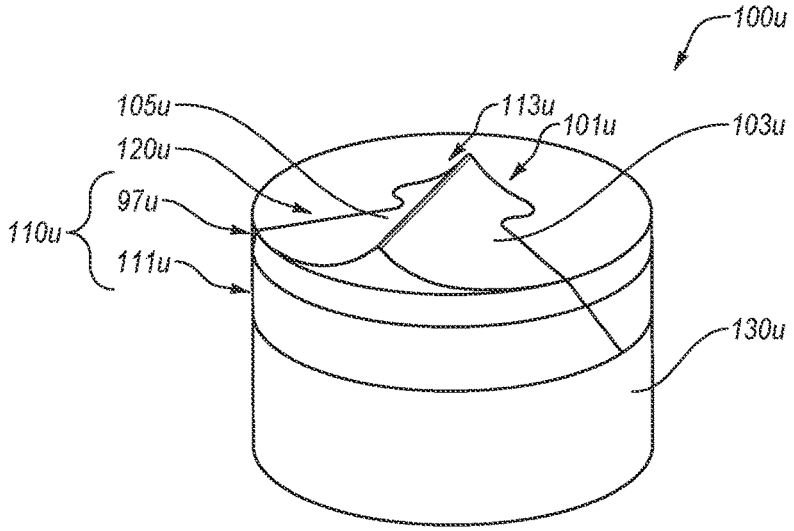

FIG. 15C illustrates a superabrasive compact 100*u* according to an embodiment. In some embodiments, the superabrasive compact 100*u* and its materials, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m*, 100*m*', 100*m*", 100*n*, 100*p*, 100*q*, 100*s* and their corresponding materials, features, elements, and components. As shown in FIG. 15C, mounting hub 110*u* may comprise a superabrasive table 97*u* which is bonded to a substrate 111*u*. In other embodiments, the superabrasive compact 100*u* may include mounting hub 110*u* and a superabrasive cutting segment 120*u*, which may be similar to or the same as the mounting hub 110*g* and superabrasive cutting segment 120*g*, respectively, of the superabrasive compact 100*g* (FIG. 8A). As shown in FIG. 15C, the superabrasive cutting segment 120*u* may be coupled with the mounting feature 113*u* of the mounting hub 110*u*. Further, FIG. 15C shows one embodiment of cutting segment 120*u* including an upper surfaces 103*u* and 105*u*, which converge to form ridge feature 101*u*. Upper surface 103*u* and/or upper surface 105*u* may be contoured, nonplanar, planar, faceted, pointed, rounded, concave, convex, curved, combinations thereof, or otherwise selectively shaped.

Furthermore, as described above, any of the superabrasive cutting segments may be bonded (e.g., brazed) to the mounting hub, to adjacent superabrasive cutting segments, to the substrate, or combinations of the foregoing. As described above, in addition to or in lieu of bonding the superabrasive cutting segments (e.g., to the mounting hub, to the substrate, or to each other), the mounting hub may secure the superabrasive cutting segments to the substrate. It should be appreciated that, in addition to braze, the mounting feature(s) of the mounting hub may restrain movement of the superabrasive cutting segment in one or more directions in a plane that is substantially coplanar with or substantially parallel to the upper surfaces of the hub and/or superabrasive cutting segment(s). In some embodiments, the mounting feature(s) of the mounting hub may restrain or limit axial movement of the superabrasive cutting segments (e.g., to prevent or limit the superabrasive cutting segments from moving in a manner that would move the upper surface of the mounting hub relative to the upper surface(s) of the superabrasive cutting segment(s)). As such, for example, the mounting feature(s) may provide or facilitate a stronger connection between the superabrasive cutting segment(s) and the substrate (e.g., compared with a connection without the mounting feature(s)), such that the superabrasive cutting segments remain secured to the substrate during operation.

Figure 16A:
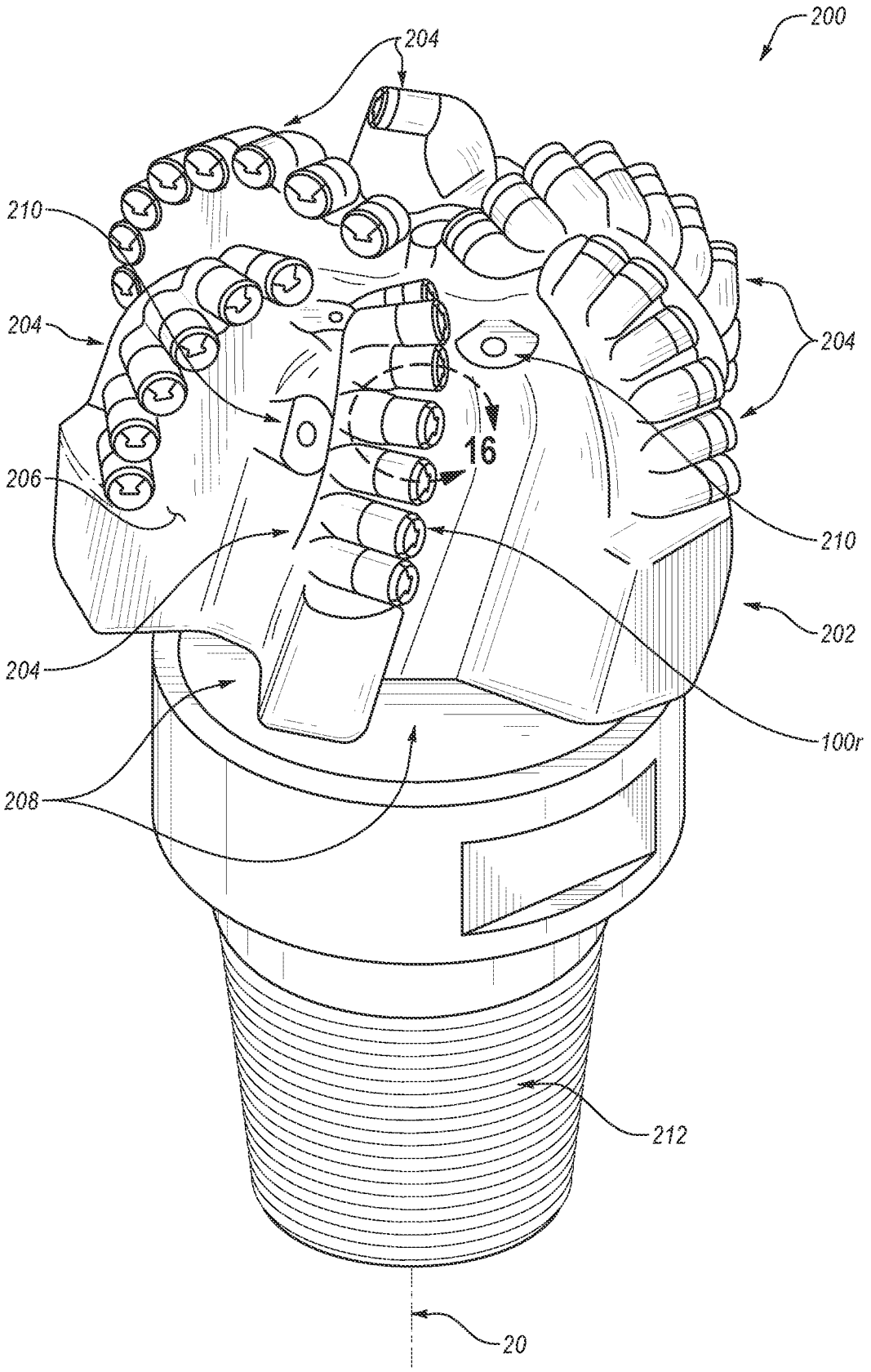
FIG. 16A is an isometric view of a rotary drill bit, according to an embodiment.
Figure 16B:
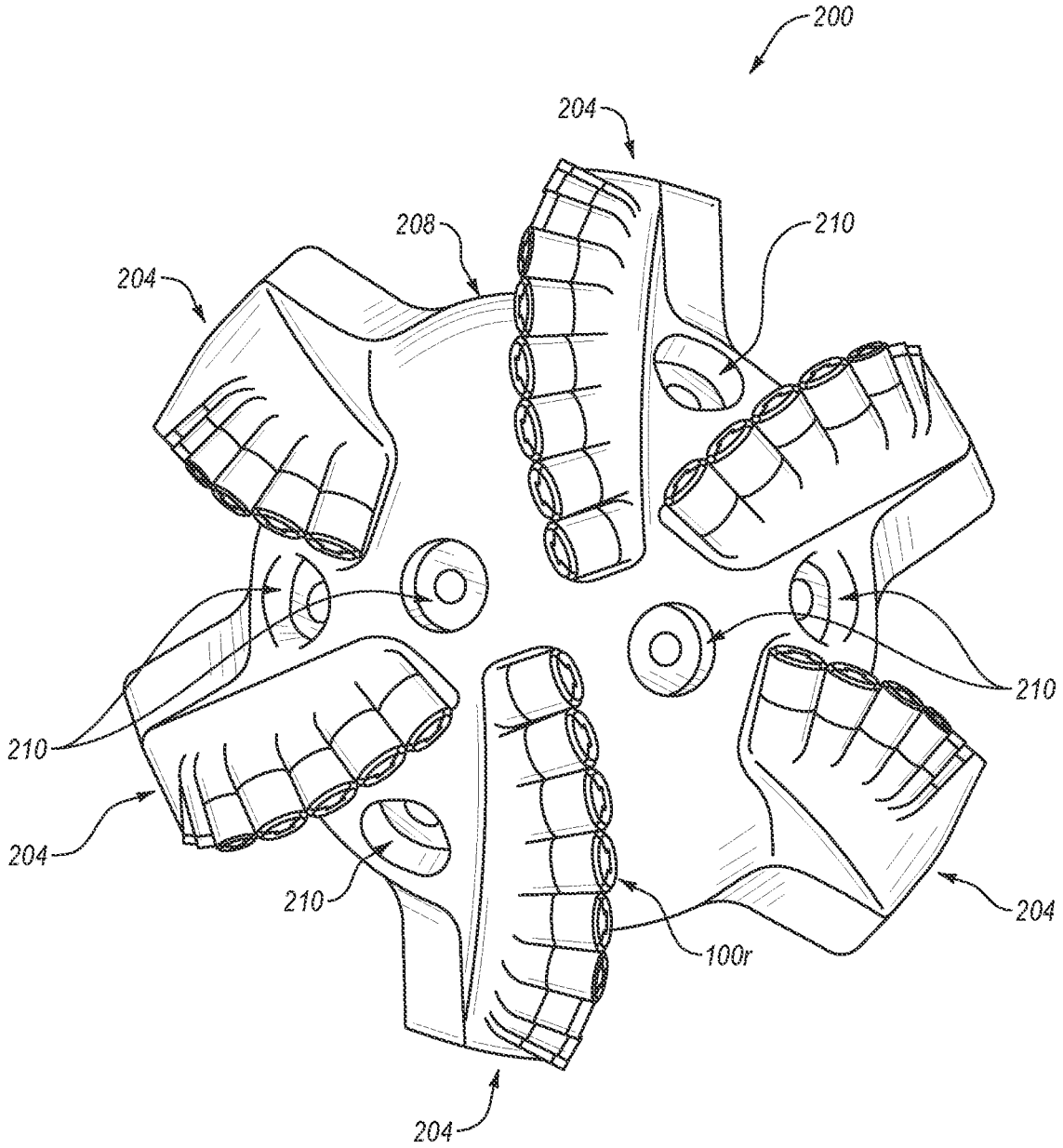
FIG. 16B is a top plan view of the rotary drill bit of FIG. 16A.

The superabrasive compacts disclosed herein may be used in a number of different types of drilling equipment. FIGS. 16A-16B illustrate a rotary drill bit 200 according to an embodiment. Specifically, FIG. 16A is an isometric view and FIG. 16B is a top elevation view of the rotary drill bit 200 that includes at least one superabrasive compact configured according to one or more embodiments disclosed herein. The rotary drill bit 200 comprises a bit body 202 that includes radially and longitudinally extending blades 204 having leading faces 206. Circumferentially adjacent blades 204 define so-called junk slots 208 therebetween. The bit body 202 defines a leading end structure for drilling into a subterranean formation by rotation about a longitudinal axis 20 and application of weight-on-bit. The rotary drill bit 200 includes a plurality of nozzle cavities 210 for communicating drilling fluid from the interior of the rotary drill bit 200 to the superabrasive compact 100*r*. Generally, the rotary drill bit 200 may be mounted to a drill string with any number of suitable connections. In the illustrated embodiment, the rotary drill bit 200 has a threaded pin connection 212 for connecting the bit body 202 to a drilling string.

At least one superabrasive compact 100*r* or a plurality of superabrasive compact 100*r*, which may be configured according to any embodiment disclosed herein, may be affixed to or integrated with the bit body 202. Moreover, each of a plurality of superabrasive compacts 100*r* is secured to or integrated with corresponding ones of the blades 204 of the bit body 202. The two or more or all of the superabrasive compact 100*r* may be the same as or similar to one another. Alternatively, the rotary drill bit 200 may include any number of suitable superabrasive compacts at least one or some of which may be different from other superabrasive compacts.

FIGS. 16A-16B merely depict one embodiment of a rotary drill bit that employs at least one superabrasive compact fabricated and structured in accordance with the disclosed embodiments, without limitation. The rotary drill bit 200 is used to represent any number of earth-boring tools or drilling tools, including, for example, core bits, roller-cone bits, fixed-cutter bits, eccentric bits, bi-center bits, reamers, reamer wings, or any other downhole tool including superabrasive compacts, without limitation.

Figure 17:
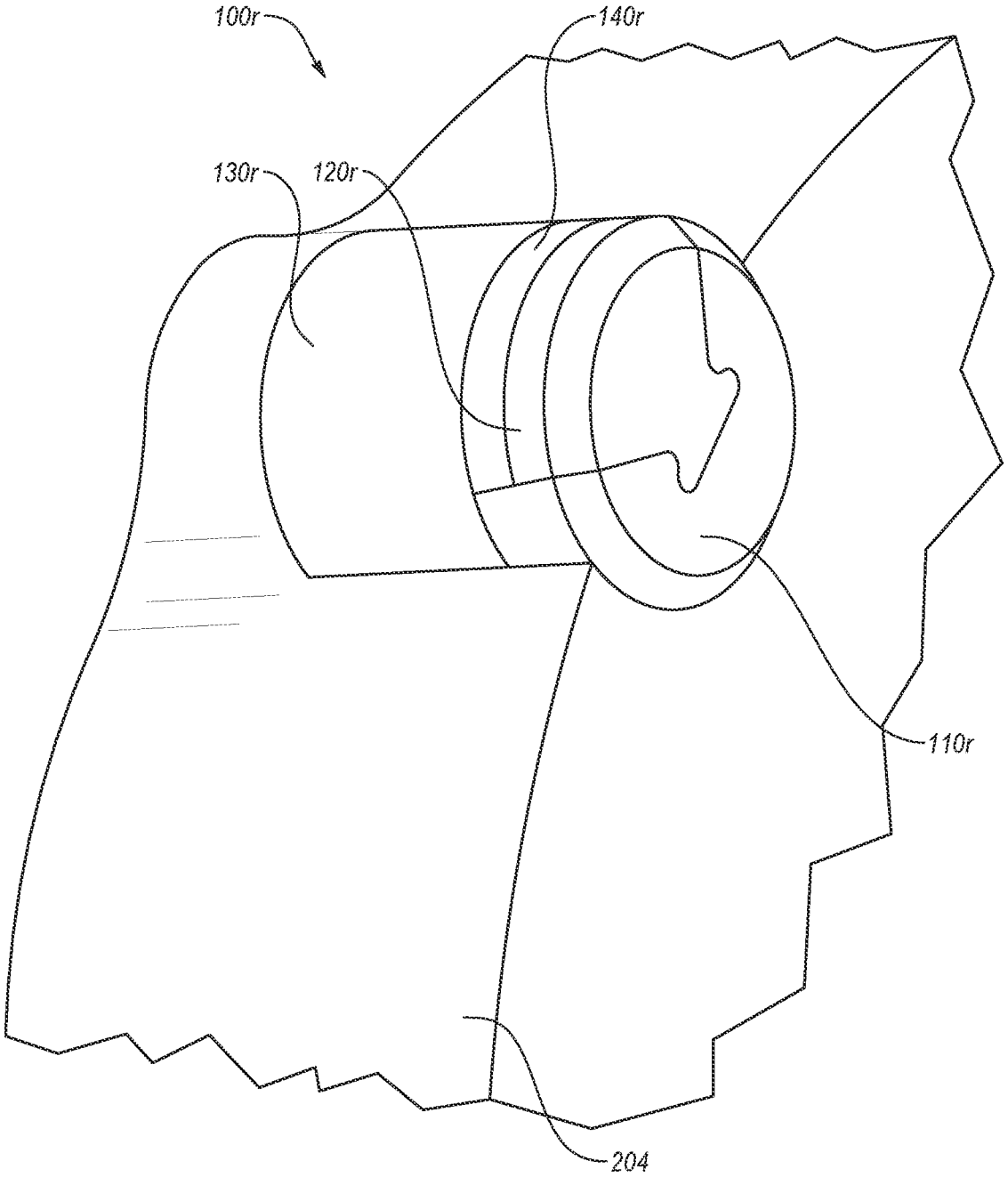
FIG. 17 is an enlarged isometric view of a portion of the rotary drill bit of FIG. 16A.

FIG. 17 is an enlarged isometric view of a portion of the rotary drill bit 200 (as indicated in FIG. 16A). As shown in FIG. 17 and described above, the superabrasive compact 100*r* may be mounted to the blade 204. In some embodiments, the superabrasive compact 100*r* and its materials, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m*, 100*m*', 100*m*", 100*n*, 100*p*, 100*q*, 100*s*, 100*t*, 100*u* and their corresponding materials, features, elements, and components.

The superabrasive compact 100*r* may include a mounting hub 110*r*, superabrasive cutting segment 120*r*, substrate 130*r*, and supporting element 140 that may be similar to or the same as the mounting hub 110*g*, superabrasive cutting segment 120*g*, substrate 130*g*, and supporting element 140*g* respectively, of the superabrasive compact 100*g* (FIG. 8A). In an embodiment, the blade 204 may include a recess that may accommodate at least a portion of the substrate 130*r*. For example, the superabrasive compact 100*r* (e.g., the substrate 130*r*) may be brazed to the blade 204 within the recess.

In at least one embodiment, at least a portion of the superabrasive compact 100*r* may be exposed in a manner that a cutting edge of the superabrasive compact 100*r* may engage and fail material during operation of the rotary drill bit. For example, at least a portion of the superabrasive compact 120*r* (e.g., a portion of the peripheral surface and upper surface of the superabrasive compact 120*r*) may be exposed in a manner that facilitates engagement of such portion(s) with target material and failing of such material during operation of the rotary drill bit.

Figure 18:
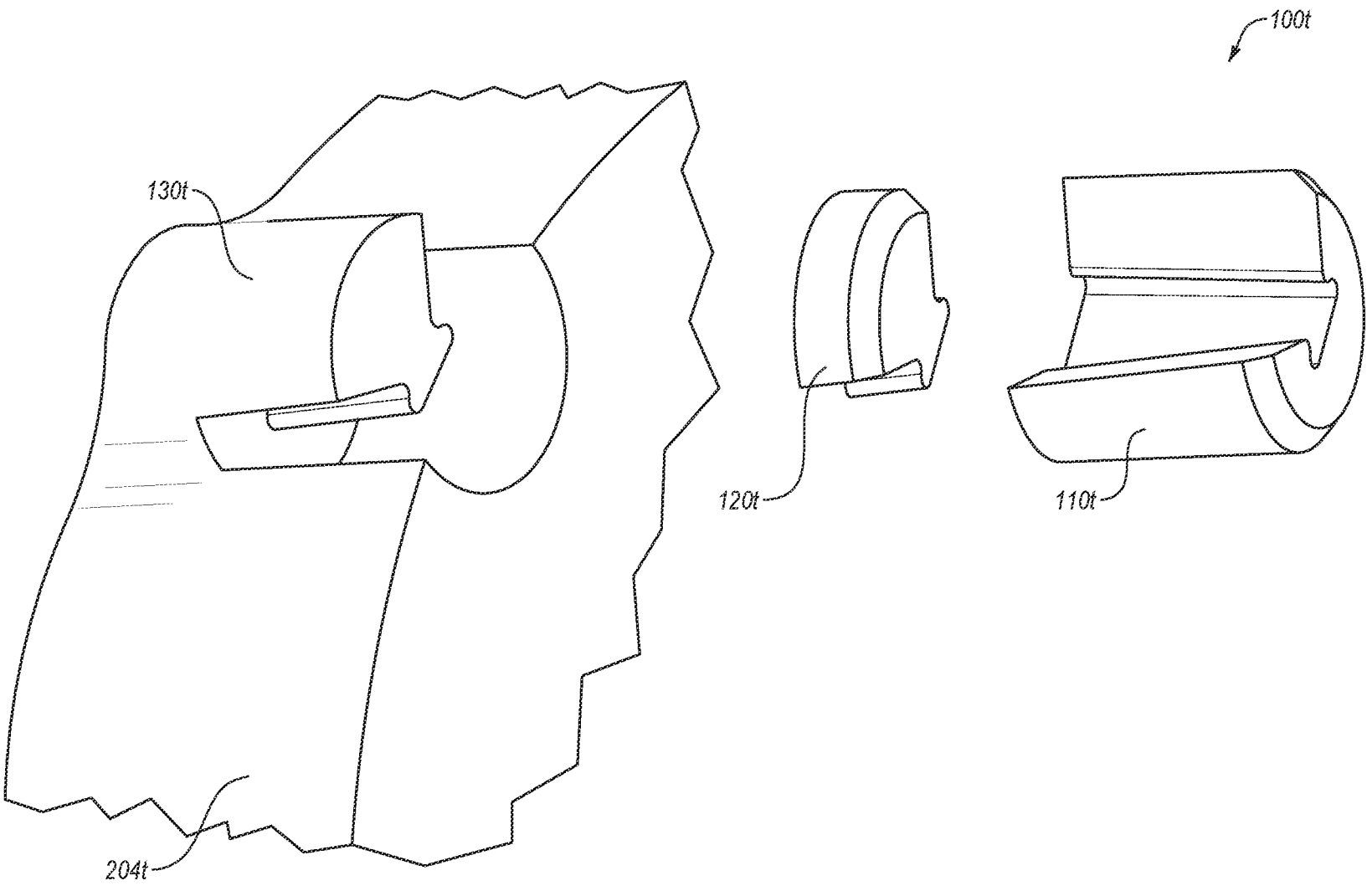
FIG. 18 is an enlarged and exploded isometric view of a portion of a rotary drill bit, according to an embodiment.

As described above, in some embodiments, at least a portion of one, some, or each of the superabrasive compacts may be integrated with the rotary drill bit. FIG. 18 illustrates a portion of a rotary drill bit according to an embodiment. In particular, FIG. 18 illustrates a blade 204*t* and a superabrasive compact 100*t* partially integrated with the blade 204*t*. In some embodiments, the superabrasive compact 100*t* and its materials, features, elements, or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m*, 100*m*', 100*m*", 100*n*, 100*p*, 100*q*, 100*r*, 100*s*, 100*t*, 100*u* and their corresponding materials, features, elements, and components.

For example, the superabrasive compact 100*t* may include a mounting hub 110*t*, superabrasive cutting segment 120*t*, and substrate 130*t*, which may be similar to the mounting hub 110*r*, superabrasive cutting segment 120*r*, substrate 130*r* of the superabrasive compact 100*r* (FIG. 17). As shown in FIG. 18, the substrate 130*t* may be integrated with the blade 204*t*. Generally, the rotary drill bit and the blade 204*t* thereof may comprise any suitable material that may vary from one embodiment to the next. For example, at least a portion of the blade 204*t* may include tungsten carbide, such as infiltrated tungsten carbide (e.g., copper-infiltrated or tin-infiltrated tungsten carbide particles). Alternatively or additionally, the blade 204*t* may include steel and/or any other suitable material. For example, the substrate 130*t* may comprise cobalt cemented tungsten carbide, steel, cemented carbide, or any other suitable material.

In an embodiment, the mounting hub 110*t* may secure or aid in securing (e.g., in addition to brazing) the superabrasive cutting segment 120*t* to the substrate 130*t* and 204*t* in a manner described above. In particular, for example, the mounting hub 110*t* may be bonded (e.g., brazed) to the substrate 130*t* and/or to the blade 204*t*, thereby at least partially restraining or securing the superabrasive cutting segment 120*t* to the substrate 130*t* and to the blade 204*t* (as described above). Furthermore, in some embodiments, the superabrasive cutting segment 120*t* may be brazed to the mounting hub 110*t* and/or to the substrate 130*t*, to provide a secure connection between the superabrasive cutting segment 120*t* and the blade 204*t*. In an embodiment, similar to superabrasive compact 100*b* (FIG. 3), a portion of the peripheral surface of the substrate 130*t* may have a complementary shape to at least a portion of the surface that defines the mounting feature of the mounting hub 110*t*.

For example, a milling drum or mining system may rotate a plurality of picks mounted or otherwise secured to the milling drum and projecting from a surface thereof. The milling drum may have a particular density and configuration of the pick placement and a variety of different pick configurations and pick spacing may be used. In an embodiment, a milling drum may be suitable for use in machining, grinding, or removing imperfections from a road material. For example, if the milling drum is configured to smooth or flatten the road material, it may be desirable to use a pick configuration that exhibits a high density and a high uniformity of pick placement and a type of the pick that does not deeply penetrate the road material.

Figure 19:
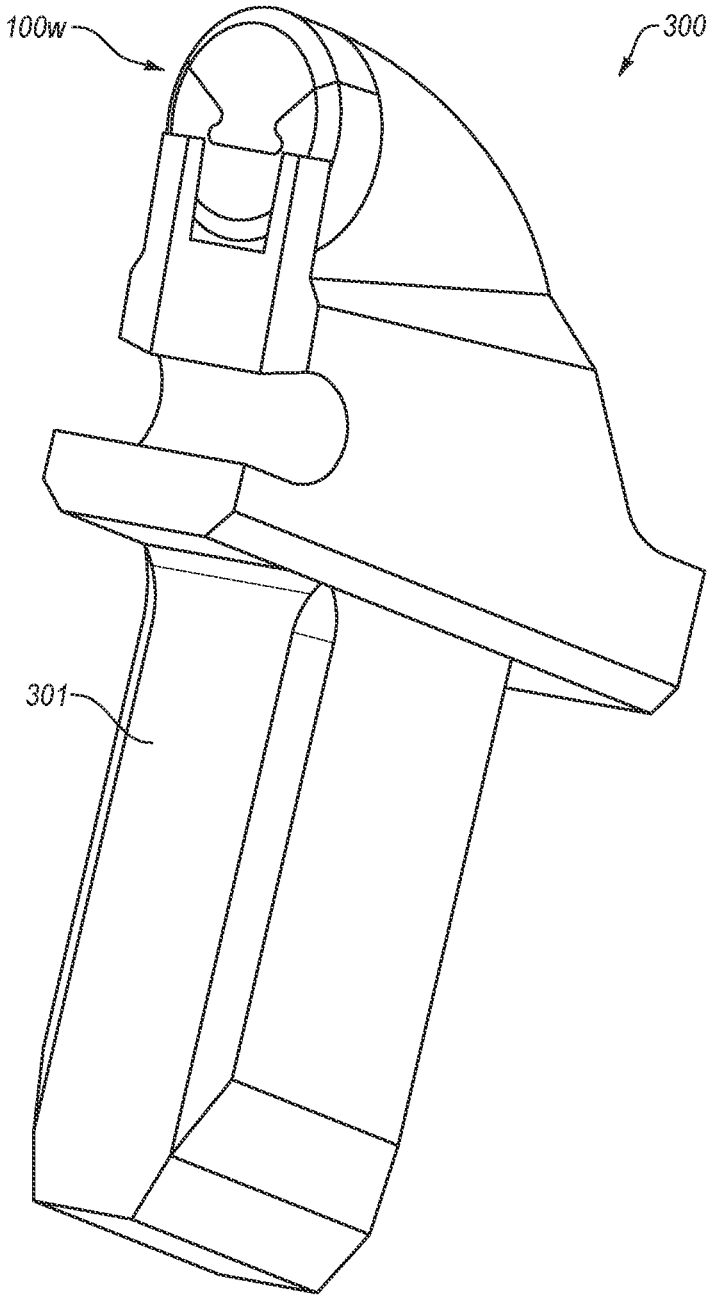
FIG. 19 is an isometric view of a pick body including at least one superabrasive compact or cutting segment according to one embodiment.

FIG. 19 illustrates a pick 300 according to an embodiment. In particular, in an embodiment, the pick 300 includes a superabrasive compact 100*w* mounted or attached to a pick body 301. The superabrasive compact 100*w* and its materials, features, elements, and/or components may be similar to or the same as the any of the superabrasive compacts 100, 100*a*, 100*b*, 100*c*, 100*d*, 100*e*, 100*f*, 100*g*, 100*g*', 100*h*, 100*k*, 100*m*, 100*m*', 100*m*", 100*n*, 100*p*, 100*q*, 100*s*, 100*t*, 100*u* and their corresponding materials, features, elements, and components.

In some embodiments, the superabrasive compact 100*w* includes a substantially planar working surface. For instance, the working surface may have an approximately semicircular shape or may have the shape of a truncated or divided circle. It should be appreciated that the superabrasive compact 100*w* and the working surface may have any number of other configurations that may vary from one embodiment to the next.

It should be appreciated that the phrase "cutting element" is used for convenience only and should not be interpreted as limiting unless the context otherwise requires. Furthermore, the superabrasive compacts or cutting elements disclosed herein may also be utilized in applications other than cutting technology. For example, the disclosed superabrasive compact embodiments may be used in wire dies, bearings, artificial joints, inserts, cutting elements, and heat sinks. Thus, any of the superabrasive compacts disclosed herein may be employed in an article of manufacture including at least one superabrasive element or compact.

Thus, the embodiments of superabrasive compacts disclosed herein may be used in any apparatus or structure in which at least one conventional superabrasive compact is typically used. In one embodiment, a rotor and a stator, assembled to form a thrust-bearing apparatus, may each include one or more superabrasive compacts configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing the superabrasive compacts disclosed herein may be incorporated. The embodiments of superabrasive compacts disclosed herein may also form all or part of heat sinks, wire dies, bearing elements, cutting elements, construction picks, construction tools, road picks, road milling tools and systems, material removal systems, surface mining tools, subterranean mining tools, tunnel boring removal implements, cutting inserts (e.g., on a roller-cone-type drill bit), machining inserts, material removal articles, or any other article of manufacture as known in the art. U.S. patent application Ser. Nos. 14/273,360; 14/275,574; 14/266,437; and 62/232,732, the disclosure of each of which is incorporated herein, in its entirety, by this reference, disclose material removal components and systems within which the superabrasive compacts disclosed herein may be incorporated. Other examples of articles of manufacture that may use any of the superabrasive compacts disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A superabrasive compact, comprising:

a mounting hub including an upper surface, a lower surface, and an inner surface at least partially defining a mounting feature;

a superabrasive cutting segment including an upper surface, a bottom surface, and a peripheral surface including at least a portion that exhibits a complementary shape to at least a first portion of the mounting feature, at least the portion of the peripheral surface of the superabrasive cutting segment being brazed to the inner surface of the mounting feature; and a substrate including a peripheral surface having at least a portion thereof brazed to at least a second portion of the mounting hub.

2. The superabrasive compact of claim 1, wherein the second portion of mounting hub at least partially defines the mounting feature and at least the portion of the peripheral surface of the substrate is brazed to the inner surface of the mounting hub and exhibits a complementary shape to at least the second portion of the inner surface of the mounting hub.

3. The superabrasive compact of claim 2, wherein the mounting hub at least partially restricts movement of the superabrasive cutting segment.

4. The superabrasive compact of claim 1, wherein the mounting feature includes a dove-tail mounting feature.

5. The superabrasive compact of claim 1, wherein the mounting hub includes polycrystalline diamond, the superabrasive cutting segment includes polycrystalline diamond that is more thermally stable than the polycrystalline diamond of the mounting hub, and the substrate includes tungsten carbide.

6. The superabrasive compact of claim 5, wherein the superabrasive cutting segment includes the polycrystalline diamond that is at least partially leached, and wherein the polycrystalline diamond of the mounting hub is substantially unleached.

7. The superabrasive compact of claim 1, wherein the substrate is brazed to the superabrasive cutting segment.

8. A rotary drill bit, comprising:

a bit body that includes a plurality of blades;

a plurality of substrates extending from one or more blades of the plurality of blades, each of the plurality of substrates including a peripheral surface and an upper surface; and a plurality of superabrasive compacts each of which is secured to a corresponding one the plurality of substrates, at least one of the plurality of superabrasive compacts including:

a mounting hub including an upper surface, a lower surface, and an inner surface having a first portion at least partially defining a mounting feature and a second portion that is brazed to at least a portion of one substrate of the plurality of substrates, the mounting hub comprising a first polycrystalline diamond material; and a superabrasive cutting segment including an upper surface, a bottom surface at least proximate to the upper surface of the substrate, and a peripheral surface including at least a portion that exhibits a complementary shape to at least the first portion of the inner surface at least partially defining the mounting feature, the superabrasive cutting segment comprising a second polycrystalline diamond material that has been at least partially leached a greater amount that the first polycrystalline diamond material of the mounting hub.

9. The rotary drill bit of claim 8, wherein at least some of the plurality of substrates include tungsten carbide and are integrated with at least some of the plurality of blades that include tungsten carbide.

10. The rotary drill bit of claim 9, wherein the mounting hub includes polycrystalline diamond and the superabrasive cutting segment includes polycrystalline diamond that is more thermally stable than the polycrystalline diamond of the mounting hub.

11. The rotary drill bit of claim 8, wherein the first polycrystalline diamond of the mounting hub is substantially unleached.

12. The rotary drill bit of claim 8, wherein the second portion of the inner surface at least partially defines the mounting feature and at least the portion of the peripheral surface of the substrate is brazed to an inner surface of the mounting hub and exhibits a complementary shape to at least the second portion of the inner surface.

13. The rotary drill bit of claim 12, wherein the mounting hub at least partially restricts movement of the superabrasive cutting segment.

14. The rotary drill bit of claim 8, wherein the mounting feature includes a dove-tail mounting feature.

15. The rotary drill bit of claim 8, wherein the substrate is brazed to the superabrasive cutting segment.

16. A rotary drill bit, comprising:

a bit body that includes a plurality of blades;

a plurality of substrates extending from one or more blades of the plurality of blades, each of the plurality of substrates including a peripheral surface and an upper surface; and a plurality of superabrasive compacts each of which is secured to a corresponding one of the plurality of substrates, at least one of the plurality of superabrasive compacts including:

a mounting hub including an upper surface, a lower surface, and an inner surface having a first portion and a second portion, the second portion at least partially defining a mounting feature that exhibits a complementary shape to at least a portion of the peripheral surface of a substrate of the plurality of substrates, a portion of the mounting hub directly bordering a portion of the substrate; and a superabrasive cutting segment including an upper surface, a bottom surface at least proximate to the upper surface of the substrate, and a peripheral surface, a thickness of the superabrasive cutting segment extending from the upper surface to the bottom surface of the superabrasive cutting segment being substantially uniform.

17. The rotary drill bit of claim 16, wherein at least some of the plurality of substrates are integrated with at least some of the plurality of blades.

18. The rotary drill bit of claim 17, wherein:

the first portion of the inner surface of the mounting hub at least partially defines the mounting feature;

at least a portion of the peripheral surface of the superabrasive cutting segment exhibits a complementary shape to at least the first portion of the inner surface of the mounting hub.

19. The rotary drill bit of claim 18, wherein the mounting hub at least partially restricts movement of the superabrasive cutting segment and the substrate is brazed to the superabrasive cutting segment.

20. The rotary drill bit of claim 16, wherein the mounting hub includes polycrystalline diamond and the superabrasive cutting segment includes at least partially leached polycrystalline diamond that is more thermally stable than the polycrystalline diamond of the mounting hub.

21. A rotary drill bit, comprising:

a bit body that includes a plurality of blades; and a plurality of superabrasive compacts extending from one or more blades of the plurality of blades, at least one of the plurality of superabrasive compacts including:

a mounting hub including an upper surface, a lower surface, and an inner surface at least partially defining a mounting feature;

a superabrasive cutting segment including an upper surface, a bottom surface, and a peripheral surface including at least a portion that exhibits a complementary shape to at least a first portion of the mounting feature, at least the portion of the peripheral surface of the superabrasive cutting segment being brazed to the inner surface of the mounting feature; and a substrate including a peripheral surface having at least a portion thereof brazed to at least a second portion of the mounting hub.

* * * * *